US011201408B2

(12) United States Patent
Ban et al.

(10) Patent No.: US 11,201,408 B2
(45) Date of Patent: Dec. 14, 2021

(54) ANTENNA DESIGN SUPPORT APPARATUS AND ANTENNA DESIGN SUPPORT METHOD

(71) Applicant: FUJITSU LIMITED, Kawasaki (JP)

(72) Inventors: Yasumitsu Ban, Kawasaki (JP); Manabu Yoshikawa, Yokohama (JP); Yohei Koga, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 22 days.

(21) Appl. No.: 16/673,469

(22) Filed: Nov. 4, 2019

(65) Prior Publication Data

US 2020/0194895 A1 Jun. 18, 2020

(30) Foreign Application Priority Data

Dec. 17, 2018 (JP) ..... JP2018-235846

(51) Int. Cl.
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
CPC ..... H01Q 1/38–1/48; H01Q 9/04
See application file for complete search history.

(56) References Cited

U.S. PATENT DOCUMENTS

2011/0063180 A1* 3/2011 Su ..... H01Q 3/24 343/795
2012/0027056 A1 2/2012 Shinkai et al.
2013/0314285 A1* 11/2013 Takasaki ..... H01Q 9/0407 343/700 MS

FOREIGN PATENT DOCUMENTS

JP 06-334427 A 12/1994
WO WO-2015-156096 A1 10/2015
WO WO-2010-073429 A1 7/2017

* cited by examiner

*Primary Examiner* — Hasan Islam
(74) *Attorney, Agent, or Firm* — Arent Fox LLP

(57) ABSTRACT

A non-transitory computer-readable recording medium having stored therein a program that, when a processor coupled to a memory and the processor is configured to execute the program, causes the processor configured to: store, in the memory, a design data of a metal member disposed around the patch antenna having a ground conductor and an antenna element having a power feeding point, and a positional relationship between the metal member and the patch antenna; and determine a relative position between the power feeding point and the metal member so that a center point and the power feeding point of the patch antenna in plan view are located on a perpendicular line to a surface of the metal member on the patch antenna side based on the design data of the metal member and the positional relationship stored in the memory.

8 Claims, 23 Drawing Sheets

| IoT DEVICE MODEL | | PATCH ANTENNA | | |
|---|---|---|---|---|
| ID | SIZE (x,y,z)(mm) | CENTER POINT (x,y,z) | RADIUS (mm) | POWER FEEDING POINT |
| IoT001 | (100,100,100) | x1,y1,z1 | 20 | x2,y2,z2 |

ANTENNA DESIGN SUPPORT APPARATUS AND ANTENNA DESIGN SUPPORT METHOD

CROSS-REFERENCE TO RELATED APPLICATION

This application is based upon and claims the benefit of priority of the prior Japanese Patent Application No. 2018-235846, filed on Dec. 17, 2018, the entire contents of which are incorporated herein by reference.

FIELD

The embodiments discussed herein are related to an antenna design support apparatus and an antenna design support method.

BACKGROUND

In the related art, provided is an array antenna device including a plurality of variable directivity antenna each having one power feeding antenna element and at least one parasitic antenna element, and at least one metal block longer than the length of the power feeding antenna element in the longitudinal direction.

At least two of the plurality of variable directivity antennas are excited simultaneously. At least one of the metal blocks having a predetermined distance to each of the power feeding antenna elements is provided and acts as a reflector for the power feeding antenna element, and each of the parasitic antenna elements includes a switch circuit for switching the electrical length.

The feature is such that the parasitic antenna element operates as a reflector by switching the electrical length by the switch circuit, the power feeding antenna element included in the variable directivity antenna which is identical to the variable directivity antenna including the parasitic antenna element (see, for example, International Publication Pamphlet No. WO 2010/073429).

SUMMARY

According to an aspect of the embodiments, a non-transitory computer-readable recording medium having stored therein a program that, when a processor coupled to a memory and the processor is configured to execute the program, causes the processor configured to: store, in the memory, a design data of a metal member disposed around the patch antenna having a ground conductor and an antenna element having a power feeding point, and a positional relationship between the metal member and the patch antenna; and determine a relative position between the power feeding point and the metal member so that a center point and the power feeding point of the patch antenna in plan view are located on a perpendicular line to a surface of the metal member on the patch antenna side based on the design data of the metal member and the positional relationship stored in the memory.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

In the background art as described above, the fact that the directivity of the patch antenna varies greatly depending on whether the radio wave radiated from the patch antenna is vertical polarization or horizontal polarization when the surface of the metal member is regarded as the ground when a patch antenna is disposed near a metal member is not disclosed.

Hereinafter, embodiments to which the antenna design support program, the antenna design support apparatus, and the antenna design support method of the present embodiments are applied will be described below.

Embodiments

Figure 1:
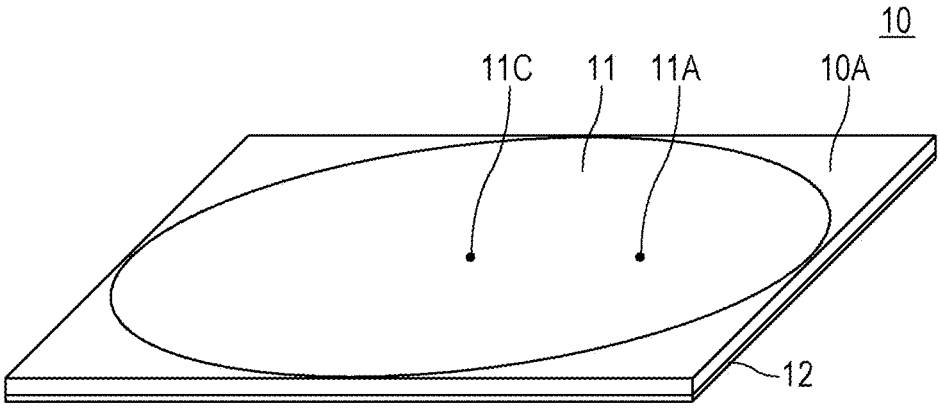
FIG. 1 is a diagram illustrating a patch antenna.

FIG. 1 is a diagram illustrating a patch antenna 10. The patch antenna 10 includes a substrate 10A, an antenna element 11, and a ground conductor 12. The substrate 10A is, as an example, a plate-like member that is square in plan view and is made of an insulator. The antenna element 11 is a disk-shaped conductor provided on one face of the substrate 10A, and is made of copper foil as an example. The antenna element 11 has a power feeding point 11A at a position offset from a center point 11C. The ground conductor 12 is a square plate-like conductor in plan view provided on the other face of the substrate 10A, and is made of copper foil as an example.

For example, a core wire of a coaxial cable inserted through the through hole provided in the substrate 10A and the ground conductor 12 is coupled to the power feeding point 11A to which power is supplied. In this case, the ground conductor 12 is coupled to the shield wire of the coaxial cable.

Figure 2A:
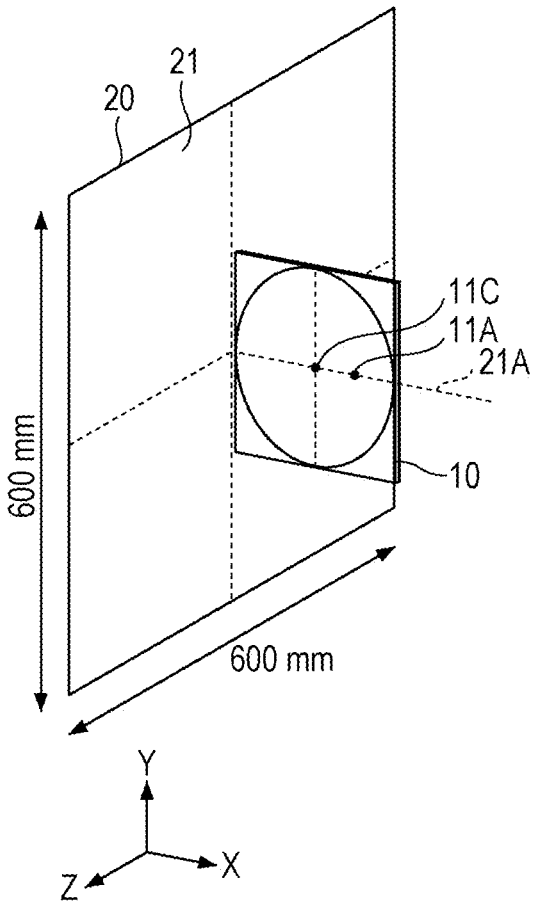
FIGS. 2A and 2B are diagrams illustrating the patch antenna and a metal member.
Figure 2B:
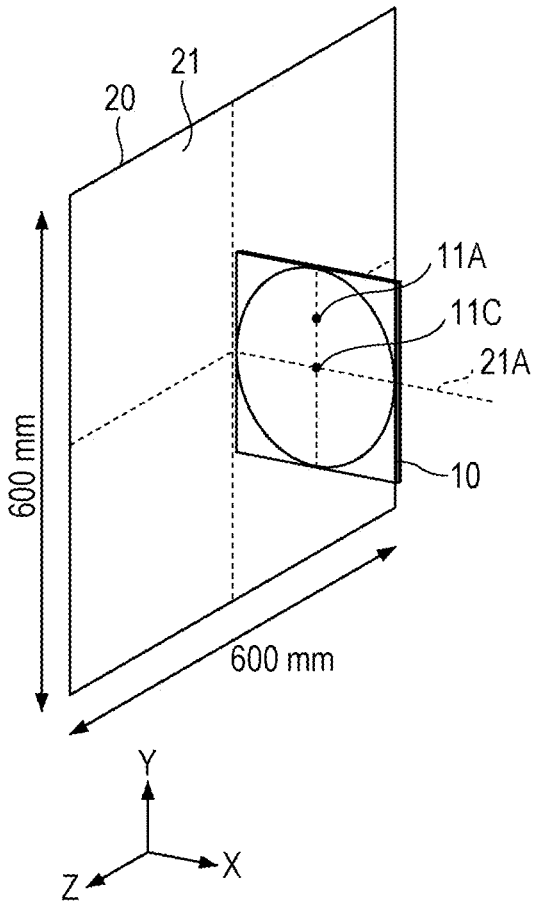

FIGS. 2A and 2B are diagrams illustrating the patch antenna 10 and a metal member 20. In FIGS. 2A and 2B, the antenna element 11 is provided on the surface of the substrate 10A on the Z-axis positive direction side. FIGS. 2A and 2B illustrate different positions of the power feeding point 11A. Hereinafter, description will be made using the XYZ coordinate system as the orthogonal coordinate system.

As an example, the metal member 20 is a metal plate extending in the YZ plane, and has a dimension of 600 mm in the Y-axis direction and the Z-axis direction. A surface 21 of the metal member 20 corresponds to a ground face that extends infinitely in the YZ plane direction with respect to the patch antenna 10. While the metal member 20 may have any dimensions in the X-axis direction, it is assumed to be several mm as an example.

In FIGS. 2A and 2B, the metal member 20 is disposed on the X-axis negative direction side of the patch antenna 10. The surface 21 of the metal member 20 is the patch antenna 10 side surface, and the metal member 20 and the patch antenna 10 are away from each other. The perpendicular line perpendicular to the surface 21 is parallel to the X-axis direction.

In FIG. 2A, the power feeding point 11A is on a perpendicular line 21A perpendicular to the surface 21 where the perpendicular line 21A passes through the center point 11C, and is located on the X-axis positive direction side relative to the center point 11C. In FIG. 2B, the power feeding point 11A is located at a position obtained by rotating the power feeding point 11A illustrated in FIG. 2A counterclockwise by 90 degrees in XY plan view. In other words, in FIG. 2B, the power feeding point 11A is not present on the perpendicular line 21A perpendicular to the surface 21 where the perpendicular line 21A passes through the center point 11C, but is present on the straight line parallel to the Y-axis passing through the center point 11C and is located on the Y-axis positive direction side relative to the center point 11C.

Figure 3A:
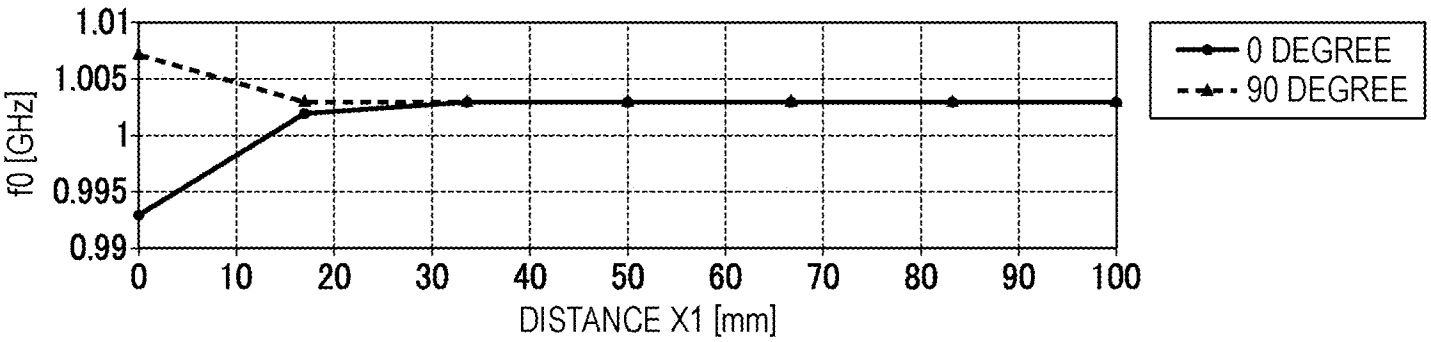
FIGS. 3A to 3C are diagrams illustrating radiation characteristics of the patch antenna.
Figure 3B:
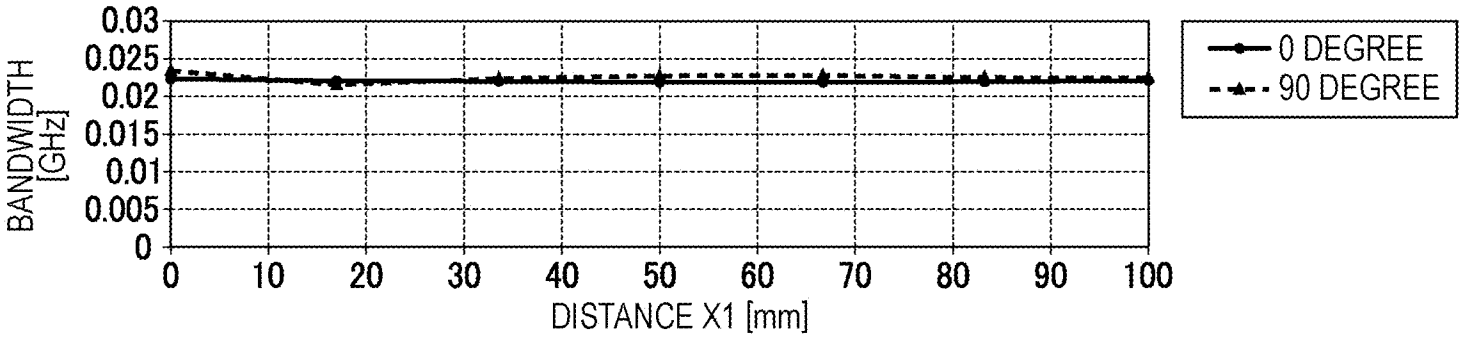
Figure 3C:
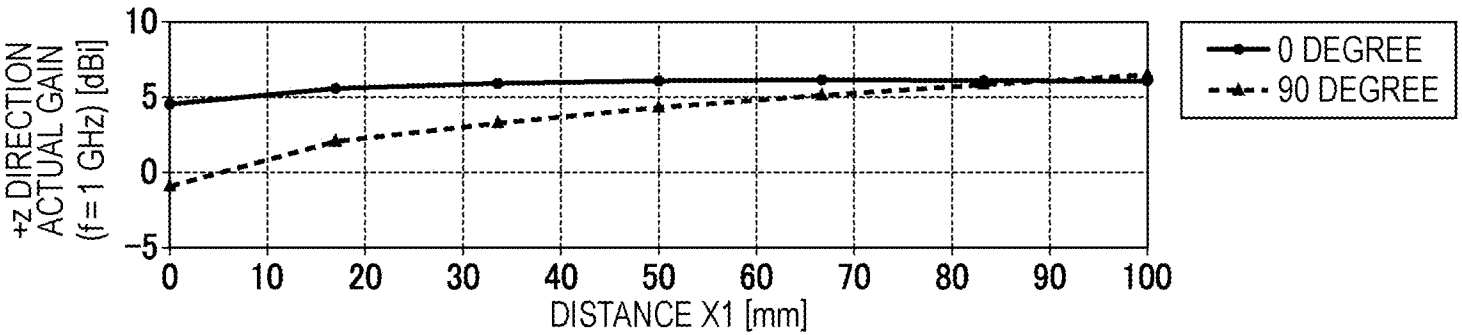

FIGS. 3A to 3C are diagrams illustrating the radiation characteristics of the patch antenna 10 illustrated in FIGS. 2A and 2B. The radiation characteristics illustrated in FIGS. 3A to 3C are obtained by the electromagnetic field simulation. The patch antenna 10 illustrated in FIG. 2A is referred to as a 0-degree patch antenna 10, the patch antenna 10 illustrated in FIG. 2B is referred to as a 90-degree patch antenna 10, and both antennas are distinguished. In FIGS. 3A to 3C, the characteristics of the 0-degree patch antenna 10 are indicated by a solid line, and the characteristics of the 90-degree patch antenna 10 are indicated by a broken line.

FIG. 3A illustrates the variation of the resonance frequency f0 with respect to the distance X1 between the end of the antenna element 11 on the X-axis negative direction side and the surface 21 of the metal member 20. As an example, the resonance frequency of the patch antenna 10 in the free space is 1.003 GHz. The end of the antenna element 11 on the X-axis negative direction side refers to an intersection of the perpendicular line 21A passing through the center point 11C and the outer periphery of the antenna element 11.

The resonance frequencies of the 0-degree and the 90-degree patch antenna 10 are both 1.003 GHz with almost no change when the distance X1 is about 100 mm to about 33 mm. The resonance frequency of the 0-degree patch antenna 10 decreases to about 1.002 GHz when the distance X1 is about 33 mm to about 17 mm, and decreases to about 0.993 GHz as the distance X1 approaches 0 mm.

The resonance frequency of the 90-degree patch antenna 10 hardly changes at about 1.003 GHz when the distance X1 is from 100 mm to about 17 mm, and increases to about 1.008 GHz as it approaches from about 17 mm to 0 mm.

As described above, when the distance X1 was reduced from 100 mm to 0 mm, the resonance frequency of the 0-degree patch antenna 10 decreases by about 10 MHz, and the resonance frequency of the 90-degree patch antenna 10 increases by about 5 MHz. As a result, it has been found that the changes in the resonance frequencies of the 0-degree and the 90-degree patch antenna 10 with respect to the change in the distance X1 are both minute. Setting the distance X1 to 0 mm means that the antenna element 11 contacts the metal member 20, so that the distance X1 is not set to 0 mm.

FIG. 3B illustrates the variation of the bandwidth with respect to the distance X1. The bandwidth is the bandwidth when the value of the S11 parameter is −6 dB. As an example, the bandwidth of the patch antenna 10 in the free space is 22.35 MHz.

As illustrated in FIG. 3B, the bandwidth of the 0-degree and the 90-degree patch antenna 10 is about 22.35 MHz with almost no variation even when the distance X1 is reduced 0 mm from 100 mm. More specifically, the bandwidth variation was about 3 MHz or less.

As a result, it has been found that the bandwidth of the 0-degree and the 90-degree patch antenna 10 hardly varies for the distance X1.

FIG. 3C illustrates the variation of the actual gain in the Z-axis positive direction with respect to the distance X1. As an example, the actual gain of the patch antenna 10 in the free space is 6.11 dBi.

As illustrated in FIG. 3C, while the actual gain of the 0-degree patch antenna 10 is 5 dBi or more when the distance X1 is about 10 mm or more, the actual gain of the 90-degree patch antenna 10 is 5 dBi or more when the distance X1 is about 65 mm or more.

As a result, it has been found that the actual gain greatly varies between the 0-degree patch antenna 10 and the 90-degree patch antenna 10 depending on the distance X1 from the metal member 20.

Figure 4A:
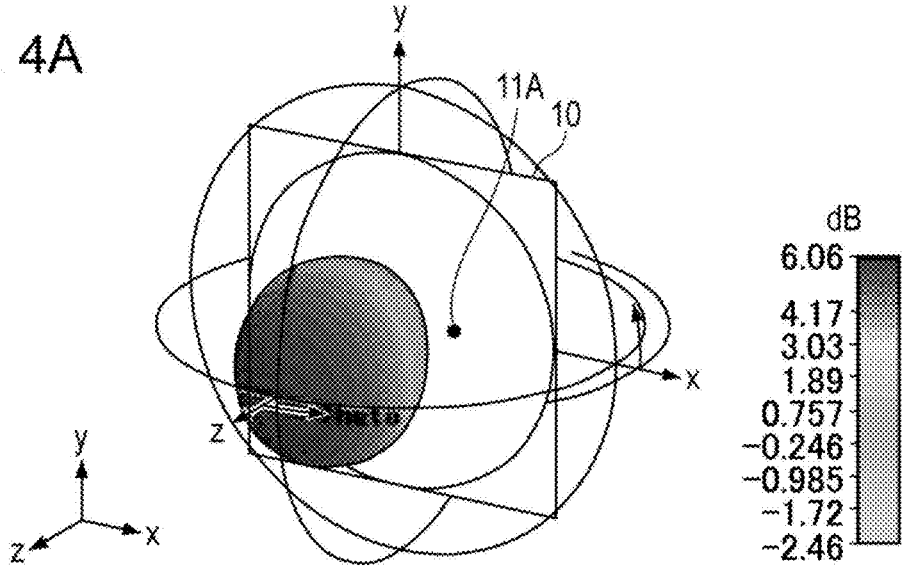
FIGS. 4A to 4C are diagrams illustrating directivity of the patch antenna.
Figure 4B:
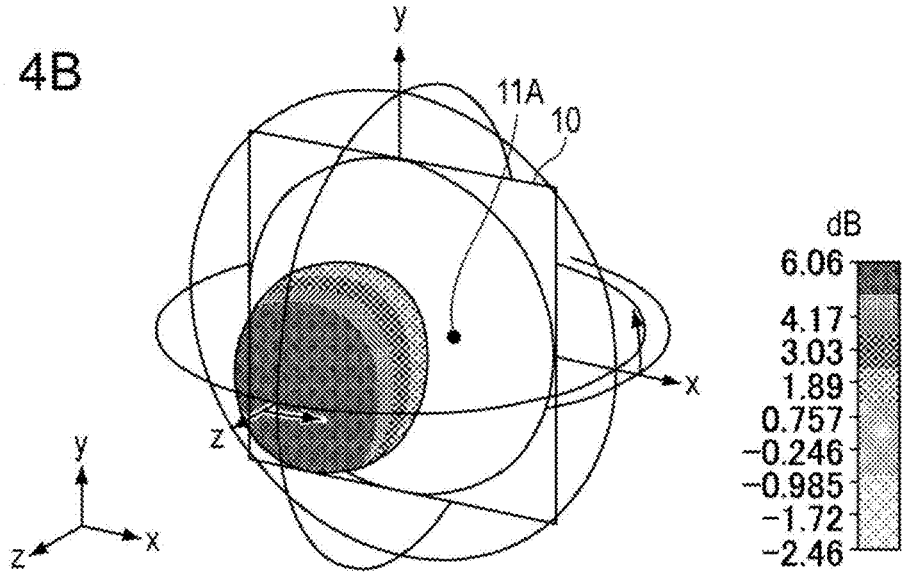
Figure 4C:
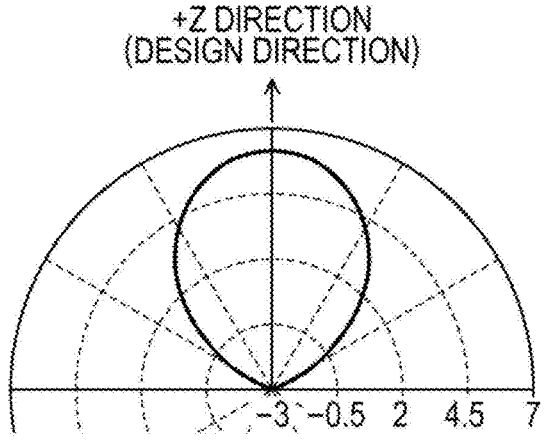

FIGS. 4A and 4C are diagrams illustrating the directivity of the patch antenna 10. FIG. 4B is a schematic diagram of FIG. 4A. The directivity illustrated in FIG. 4A is obtained by the electromagnetic field simulation. As illustrated in FIGS. 4A and 4C, the actual gain of the patch antenna 10 is maximum in the Z-axis positive direction. The patch antenna 10 illustrated in FIG. 4A is the 0-degree patch antenna 10, but the same applies to the 90-degree patch antenna 10. FIG. 4A is a diagram in which color display is converted to black and white display.

Figure 5A:
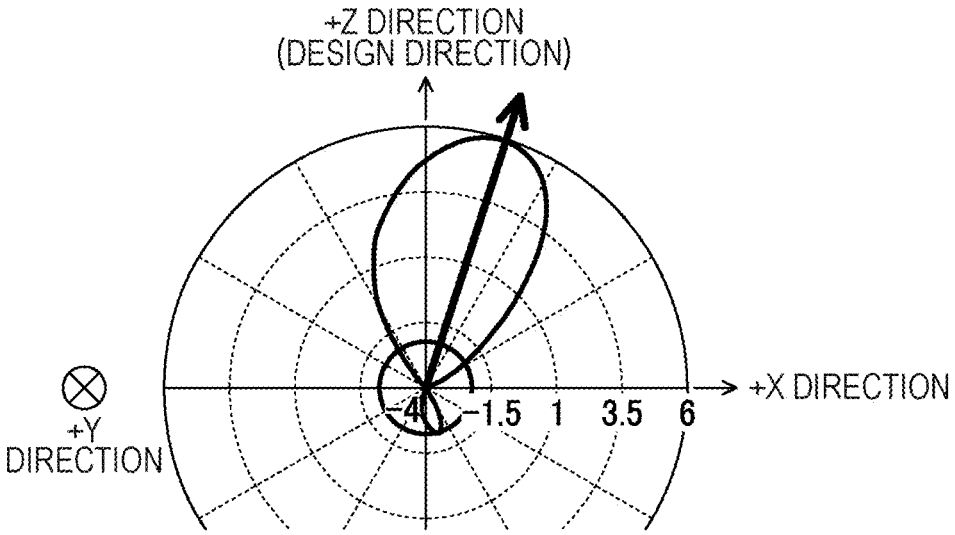
FIGS. 5A and 5B are diagrams illustrating directivity of a 0-degree and a 90-degree patch antenna.
Figure 5B:
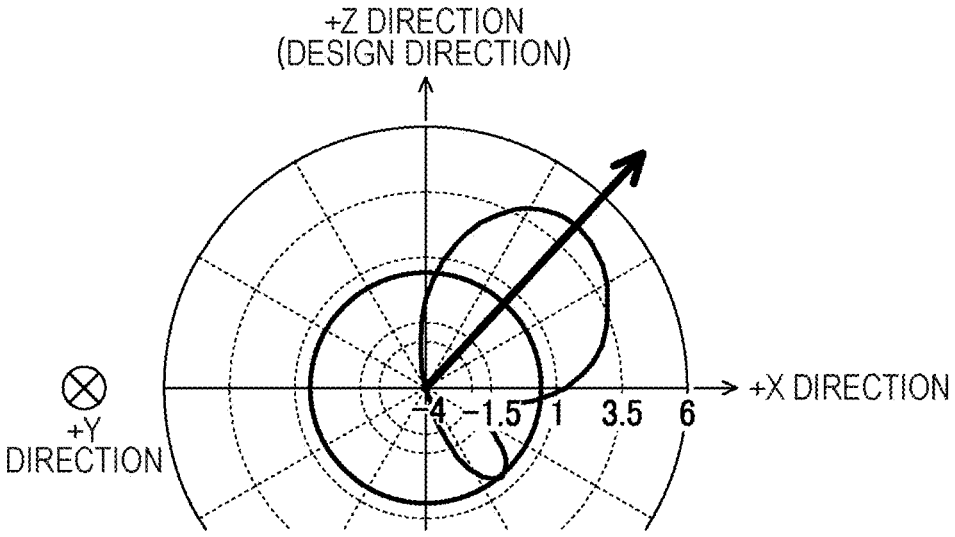

FIGS. 5A and 5B are diagrams illustrating the directivity of the 0-degree and the 90-degree patch antenna 10. The directivity illustrated in FIGS. 5A and 5B is obtained by the electromagnetic field simulation, and is obtained by the simulation results of radiation patterns (absolute gain characteristics (dB)) on the XZ plane.

As illustrated in FIG. 5A, it has been found that with 0-degree patch antenna 10, while the direction of the main lobe, indicated by the arrow, in which the directivity is the highest tilts about 15 degrees from the Z-axis positive direction (+Z direction) toward the X-axis positive direction (+X direction), the directivity in the Z-axis positive direction is obtained overall. The Z-axis positive direction (+Z direction) is a direction in which the directivity is the highest with the patch antenna 10 alone, and is the design direction. In FIG. 5A, the side lobe appears uniformly on the XZ plane at about −2 dB.

As illustrated in FIG. 5B, with the 90-degree patch antenna 10, the direction of the main lobe, indicated by the arrow, in which the directivity is the highest tilts about 45 degrees from the Z-axis positive direction (+Z direction) toward the X-axis positive direction (+X direction), and the 90-degree patch antenna 10 is greatly subject to the influence of the metal member 20, compared with the 0-degree patch antenna 10. The side lobe appears uniformly on the XZ plane at about 0.5 dB.

Figure 6A:
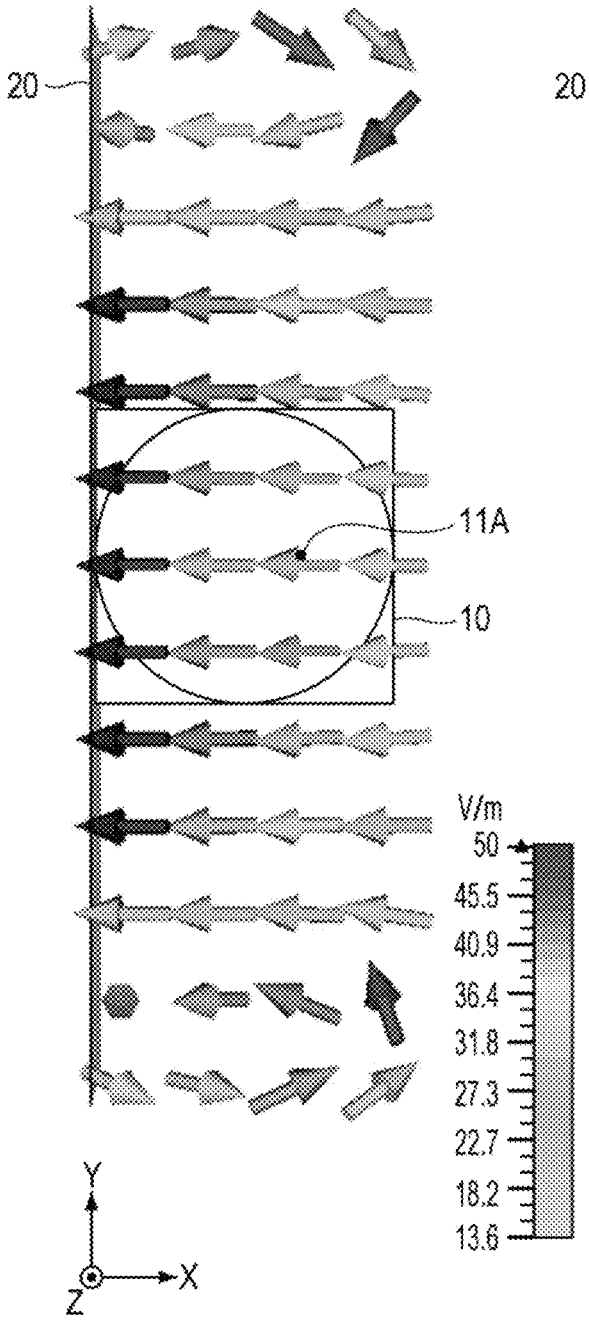
FIGS. 6A to 6D are diagrams illustrating the electric field distribution around the patch antenna disposed near the metal member.
Figure 6B:
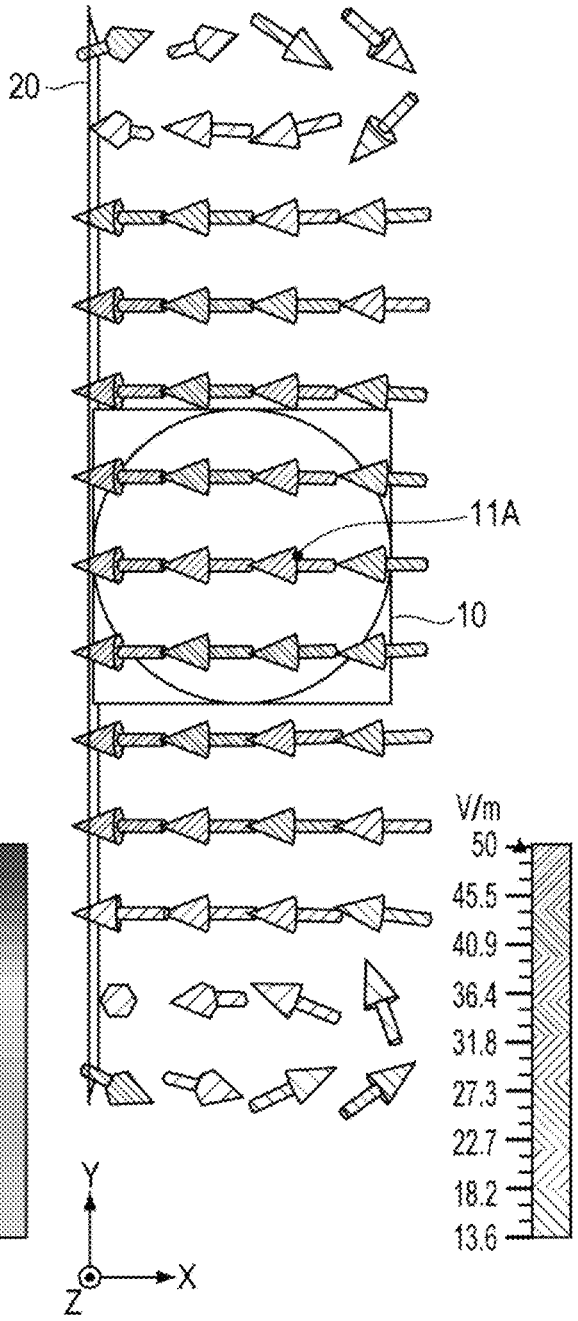
Figure 6C:
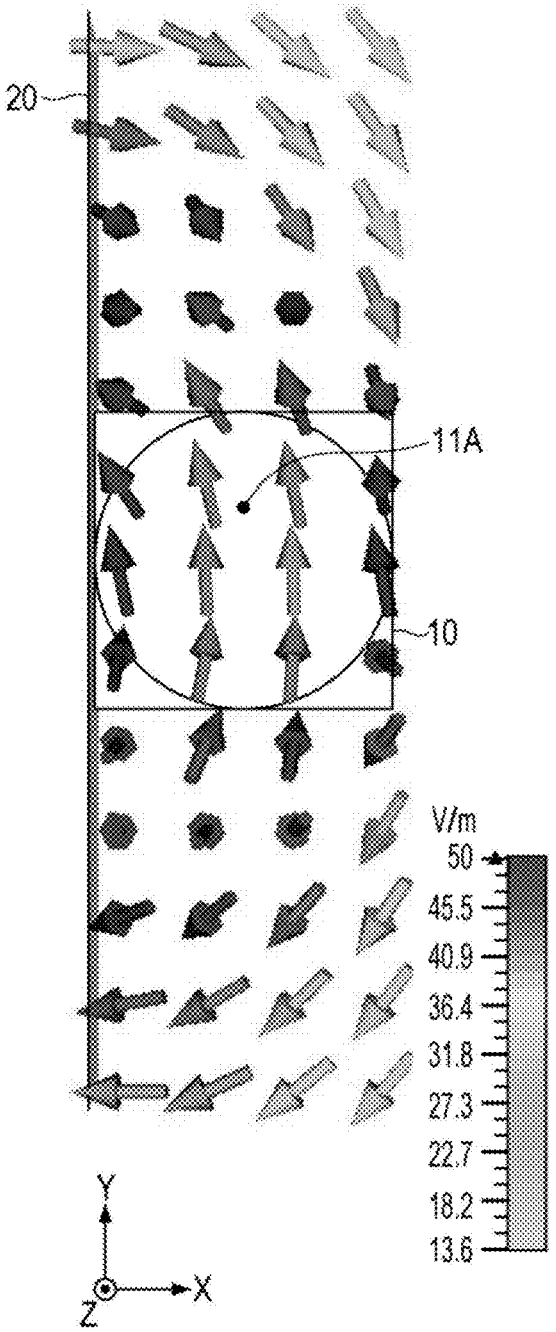
Figure 6D:
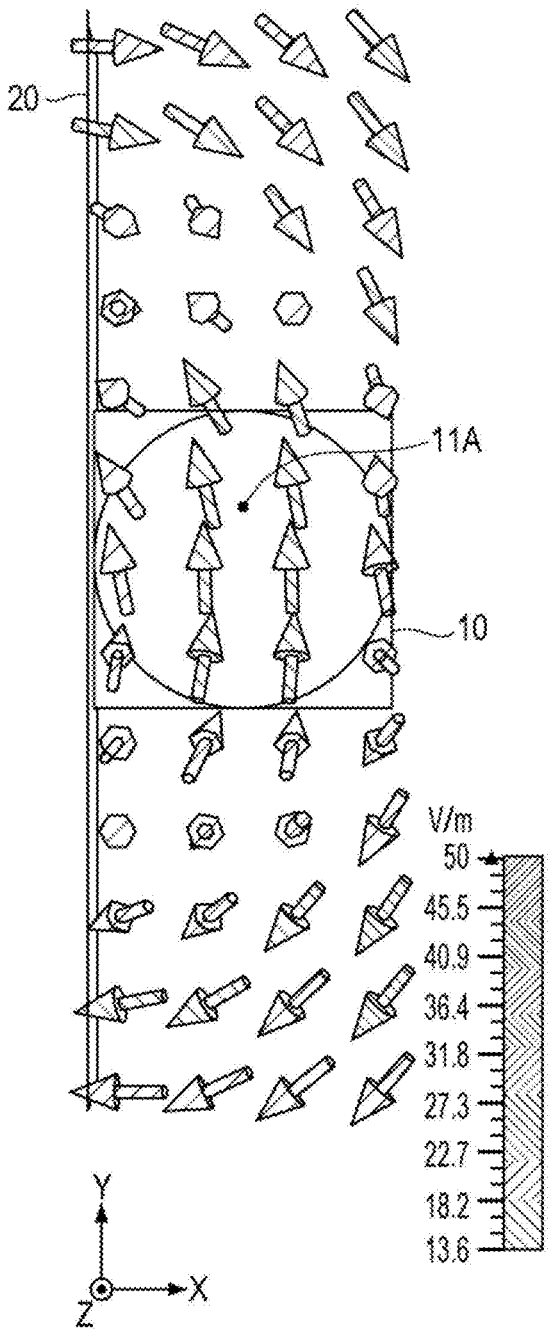

FIGS. 6A and 6C are diagrams illustrating the electric field distribution around the patch antenna 10 disposed near the metal member 20. The electric field distribution illustrated in FIGS. 6A and 6C is obtained by the electromagnetic field simulation. The electric field distribution illustrated in FIGS. 6A and 6C illustrates the electric field distribution of a combined wave of a radio wave radiated from the patch antenna 10 and a reflected wave radiated from the patch antenna 10 and reflected by the metal member 20. FIGS. 6A and 6C are diagrams in which the color display is converted into the black and white display, and FIGS. 6B and 6D are schematic diagrams of FIGS. 6A and 6C, respectively.

Assuming that the surface 21 of the metal member 20 is the ground, the electric field of the radio wave radiated from the 0-degree patch antenna 10 may be treated as vertical polarization which travels in the Z-axis direction while oscillating in the X-axis direction in the XZ plane. The electric field of the radio wave radiated from the 90-degree patch antenna 10 may be treated as vertical polarization which travels in the Z-axis direction while oscillating in the Y-axis direction in the YZ plane.

The vertical polarization is not easily reflected on the surface of the conductor (the surface 21 of the metal member 20), whereas the horizontal polarization is easily reflected on the surface of the conductor (the surface 21 of the metal member 20). For this reason, as illustrated in FIG. 6A, the magnitude and direction of the electric field of the vertical polarization are aligned without being significantly affected by the metal member 20.

On the other hand, as illustrated in FIG. 6B, it may be said that the electric field of horizontal polarization cancels out the component reflected on the surface 21 of the metal member 20, thereby reducing the electric field particularly in the region close to the patch antenna 10.

As described above, in the embodiment, when the patch antenna 10 is disposed near the metal member 20, the position of the power feeding point 11A is adjusted so that vertical polarization is obtained.

For example, when the patch antenna 10 is provided in the Internet of things (IoT) device for communication, various metal objects may exist around the IoT device. In such a case, the embodiment provides an antenna design support program, an antenna design support apparatus, and an antenna design support method that allow the patch antenna 10 with good directivity to be designed based on the positional relationship with the metal member 20.

Figure 7:
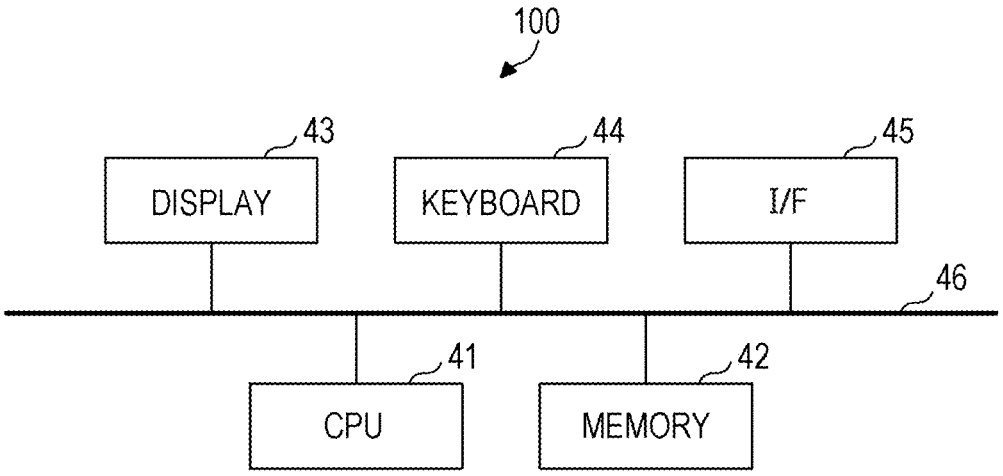
FIG. 7 is a hardware configuration diagram of an antenna design support apparatus according to an embodiment.

FIG. 7 is a hardware configuration diagram of an antenna design support apparatus 100 according to the embodiment. The antenna design support apparatus 100 operates an antenna design support program for calculating the antenna characteristics of the patch antenna 10. The antenna design support apparatus 100 may be a commonly used personal computer.

The antenna design support apparatus 100 includes a central processing unit (CPU) 41, a memory 42, a display 43, a keyboard 44, an interface (I/F) 45, and a bus 46. The CPU 41 may be a single CPU, a multi CPU, or a multi-core CPU.

The CPU 41 is an arithmetic device that implements an antenna design process by reading and executing an antenna design support program recorded in the memory 42. The antenna design support program may compose one or more programs and the programs may be stored in one or more memories as the memory 42.

The memory 42 is a storage device that stores the antenna design support program and data generated as a result of the CPU 41 executing the program. The memory 42 may be a non-volatile memory such as a flash memory or a volatile memory such as a random-access memory (RAM). The memory 42 may temporarily store a program executed by the CPU 41. As the storage device, in addition to the memory 42, another storage device such as a hard disk drive (HDD) may be used. The display 43, the keyboard 44, the I/F 45, the CPU 41, and the memory 42 are electrically coupled to each other via the bus 46.

The display 43 is a display device that displays a three-dimensional CAD operation screen for creating an analysis target model, and a touch panel may be integrated therewith.

The keyboard 44 is an input device for a user to operate the antenna design support apparatus 100 from the outside. The I/F 45 is an external coupling device that couples the antenna design support apparatus 100 with an external device. The memory 42 may include the external device may be, for example, at least one magnetic disk such as at least one flexible disk (FD) or at least one HDD, at least one optical disk such as at least one compact disc (CD) or at least one digital versatile disc (DVD), at least one magneto-optical disc (MO), or at least one non-volatile memory such as at least one flash memory. At least one computer-readable recording memory includes the t least one memory 42.

Figure 8:
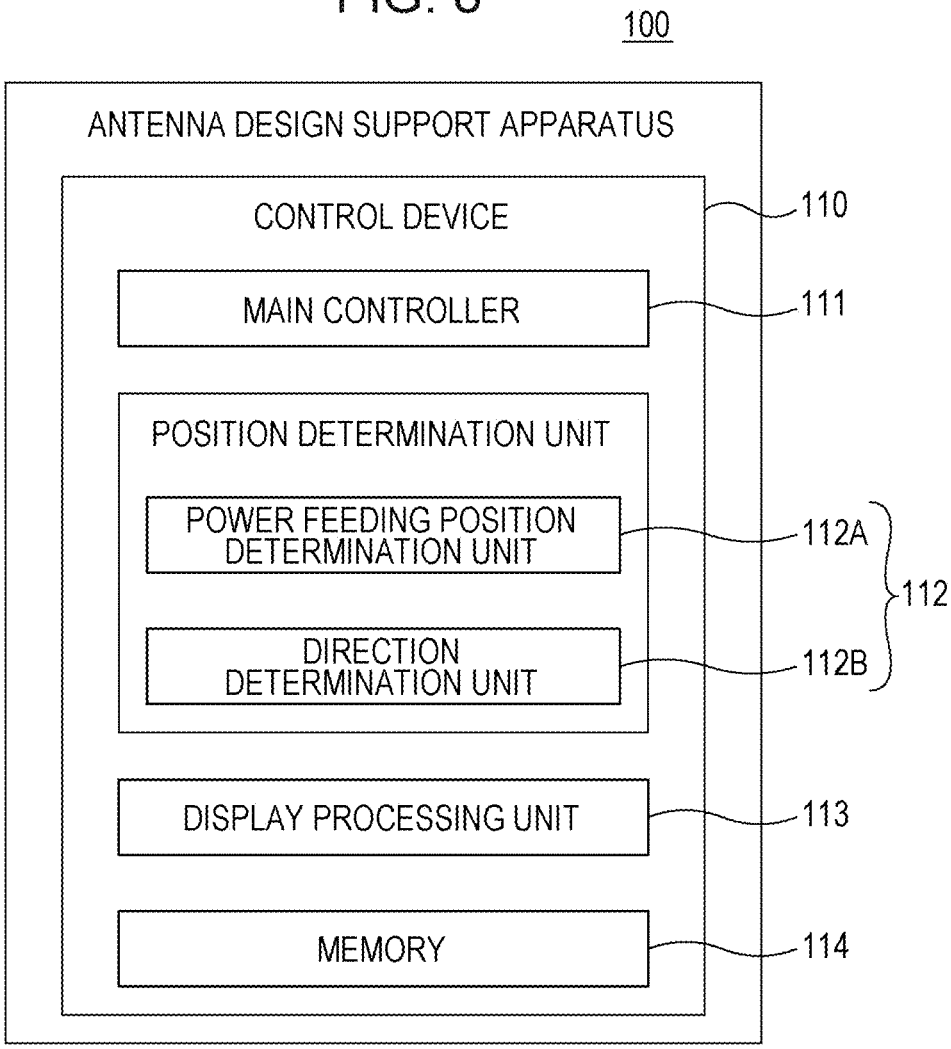
FIG. 8 is a diagram illustrating a functional configuration of a control device of the antenna design support apparatus.

FIG. 8 is a diagram illustrating a functional configuration of the control device 110 of the antenna design support apparatus 100. The function of the control device 110 is implemented by the CPU 41 and the memory 42 illustrated in FIG. 7.

The control device 110 includes a main controller 111, a position determination unit 112, a display processing unit 113, and a memory 114. The main controller 111, the position determination unit 112, and the display processing unit 113 represent functions of the control device 110, and the memory 114 functionally represents the memory of the control device 110.

The main controller 111 is a processing unit that supervises the process of the control device 110, and performs the process other than the process performed by the position determination unit 112 and the display processing unit 113.

The position determination unit 112 includes a power feeding position determination unit 112A and a direction determination unit 112B. When the positions of the patch antenna 10 and the metal member 20 are determined, the power feeding position determination unit 112A determines a position where the power feeding point is permitted to be disposed based on the relative position between the power feeding point 11A and the metal member 20.

When the position of the power feeding point 11A is determined, the direction determination unit 1128 determines the direction in which the metal member 20 is permitted to be disposed in plan view with respect to the patch antenna 10 based on the relative position of the power feeding point 11A and the metal member 20.

It may be said that the position determination unit 112 including the power feeding position determination unit 112A and the direction determination unit 112B is a processing unit that performs the following process. The position determination unit 112 is a processing unit that performs a process of determining the relative position between the power feeding point 11A and the metal member 20 so that the center of the patch antenna 10 in plan view and the power feeding point 11A are located on the perpendicular line perpendicular to the surface of the metal member 20 on the patch antenna 10 side based on the positional relationship between the metal member 20 and the patch antenna 10 disposed around the patch antenna 10. The position determination unit 112 is an example of a determination processing unit. The surface of the metal member 20 on the patch antenna 10 side is the surface closest to the patch antenna 10 of the metal member 20.

The display processing unit 113 performs a display process of displaying the contents determined by the main controller 111 and the position determination unit 112 on the display 43.

Figures 9A, 9B:
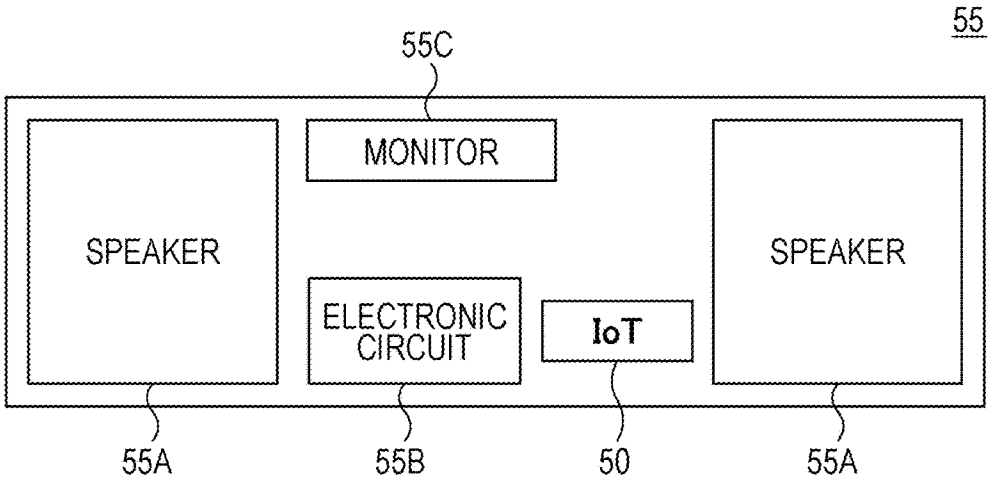
FIGS. 9A and 9B are diagrams illustrating a configuration of an IoT device model and CAD data.

FIGS. 9A and 9B are diagrams illustrating a configuration of an IoT device model 50 and computer-aided design (CAD) data. The IoT device model 50 illustrated in FIG. 9A is a human detection sensor disposed, as an example, next to a speaker 55A of an audio 55. The audio 55 includes the two speakers 55A, an electronic circuit 55B, a monitor 55C, and the like.

As an example, the IoT device model 50 as a human detection sensor detects the presence of a human using heat, light, sound, or the like. The IoT device model 50 is disposed next to one speaker 55A.

When the IoT device model 50 is disposed next to the speaker 55A, since the speaker 55A has a metal member therein, in order to obtain the desired directivity, it is desirable to dispose the patch antenna 10 so that the power feeding point 11A, the center point 11C, and the metal member 20 are in a positional relationship as illustrated in FIG. 2A as the metal member of the speaker 55A is regarded as the metal member 20.

FIG. 9B illustrates CAD data of the IoT device model 50. The CAD data of the IoT device model 50 includes the identifier (ID) and the size of the IoT device model 50, the x, y, and z coordinates of the center point 11C of the patch antenna 10, the radius of the patch antenna 10, and the x, y, and z coordinates of the power feeding point 11A of the patch antenna 10. The x, y, and z coordinates of the center point 11C and the power feeding point 11A are relative to the reference point of the IoT device model 50.

The xyz coordinate system illustrated in lower case is used in the CAD data. When the difference between the reference point in the xyz coordinate system and the reference point in the XYZ coordinate system indicated in upper case in FIGS. 2A and 2B, and the like is added to the size of the IoT device model 50, the x, y, and z coordinates of the center point 11C of the patch antenna 10, and the x, y, and z coordinates of the power feeding point 11A of the patch antenna 10, which are illustrated in FIG. 9B, the IoT device model 50 size, and the coordinates of the center point 11C and the power feeding point 11A may be expressed in the XYZ coordinate system.

Figure 10:
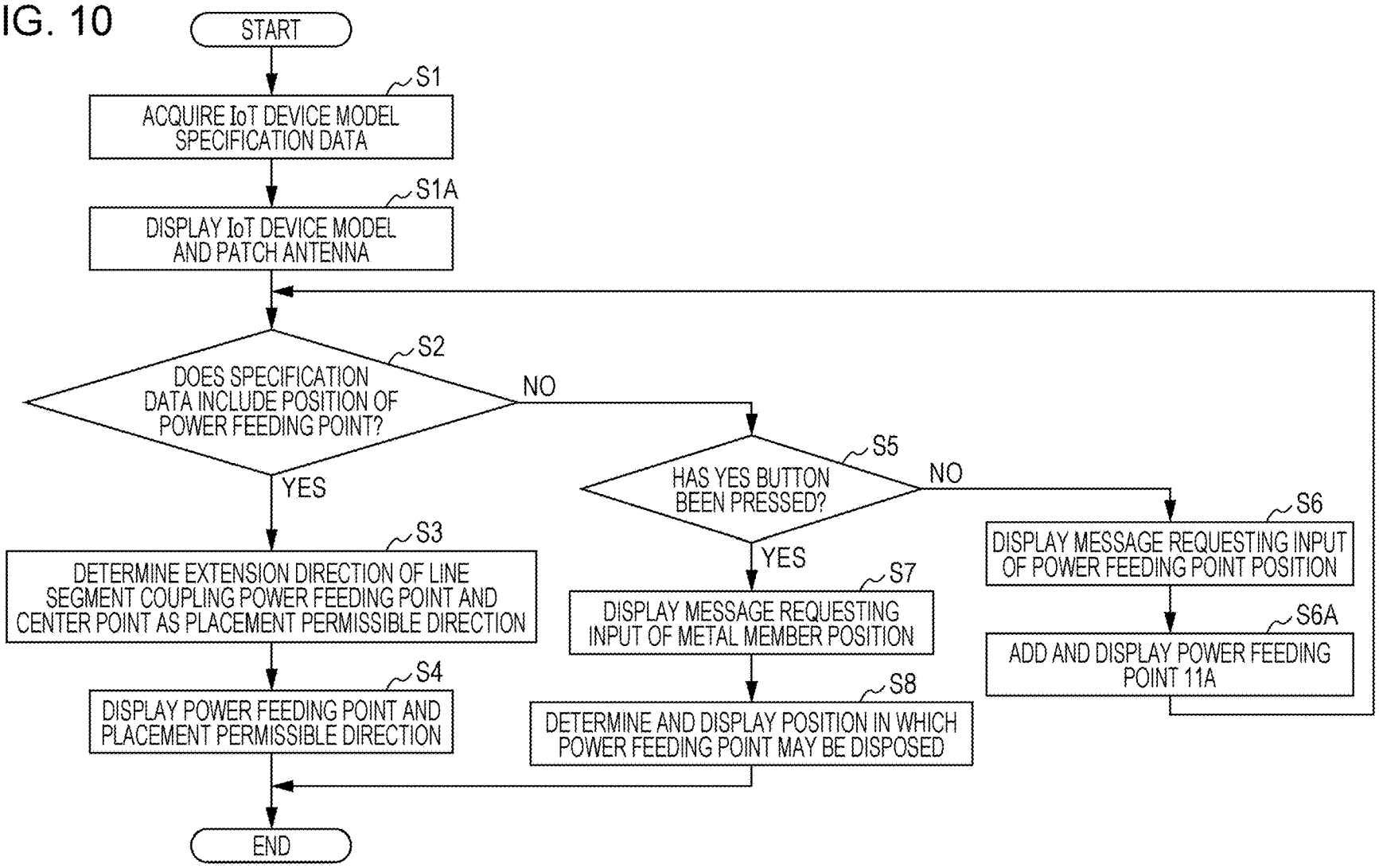
FIG. 10 is a flowchart illustrating a process of an antenna design support method of an embodiment.

FIG. 10 is a flowchart illustrating the process of the antenna design support method of the embodiment. The process illustrated in FIG. 10 is performed by the antenna design support apparatus 100 performing an antenna design support program.

When the process starts (START), the main controller 111 acquires design data of the IoT device model 50 including the patch antenna 10 (step S1). The IoT device model is a model representing an IoT device to be displayed on the display 43.

The design data is data representing specifications such as the size of the IoT device model 50, the position of each part, the position of the patch antenna 10 in the IoT device model 50, the position of the center point 11C (see FIG. 1), which is, for example, computer-aided design (CAD) data of the IoT device model 50. The design data may or may not include the position of the power feeding point 11A. For example, the main controller 111 displays, on the display 43, a message requesting input of design data, and the design data is acquired by the input by user to the antenna design support apparatus 100.

The display processing unit 113 displays the IoT device model 50 and the patch antenna 10 on the display 43 (step S1A).

The main controller 111 determines whether the design data includes the position of the power feeding point 11A (step S2).

When the main controller 111 determines that the position of the power feeding point 11A is included in the design data (S2: "YES"), the direction determination unit 112B determines that the extension direction of the line segment coupling the power feeding point 11A and the center point 11C is a placement permissible direction (step S3).

The placement permissible direction is a direction in which the metal member 20 is permitted to be disposed with respect to the patch antenna 10, and the vertical polarization illustrated in FIG. 6A is obtained when the metal member 20 is disposed in this direction as in the relationship between the patch antenna 10 and the metal member 20 illustrated in FIG. 2A. The placement permissible direction will be described later with reference to FIG. 12. The direction in which the line segment coupling the power feeding point 11A and the center point 11C extends is an example of the first direction.

The display processing unit 113 displays, on the display 43, the power feeding point 11A and the direction in which the metal member 20 is permitted to be disposed with respect to the patch antenna 10 (step S4).

When the process of step S4 by the display processing unit 113 ends, the main controller 111 ends a series of processes (END).

When the main controller 111 determines in step S2 that the position of the power feeding point 11A is not included in the design data (S2: "NO"), the main controller 111 displays, on the display 43, a message asking the user whether to determine the position of the metal member 20 and the YES/NO button, and determines whether the user has pressed the YES button (step S5).

When the main controller 111 determines that the NO button has been pressed (S5: "NO"), the main controller 111 displays, on the display 43, a message requesting the user to input the position of the power feeding point 11A and waits for the input (step S6).

The display processing unit 113 adds the power feeding point 11A to the display content of the display 43 in step S1A, and displays it (step S6A). The main controller 111 returns the flow to step S2 after completing the process of step S6A.

When the main controller 111 determines in step S5 that the YES button has been pressed (S5: "YES"), the main controller 111 displays, on the display 43, a message requesting the user to input the position of the metal member 20 and waits for input (step S7).

When the position of the metal member 20 is input by the user, the power feeding position determination unit 112A determines the position where the power feeding point 11A is permitted to be disposed based on the perpendicular line 21A perpendicular to the surface 21 of the metal member 20, and the position of the center point 11C of the antenna element 11, and displays the power feeding point 11A on the display 43 (step S8).

When the process of step S8 by the power feeding position determination unit 112A ends, the main controller 111 ends a series of processes (END).

FIGS. 11 to 15 are diagrams illustrating the display on the display 43 when the flowchart illustrated in FIG. 10 is performed.

Figure 11:
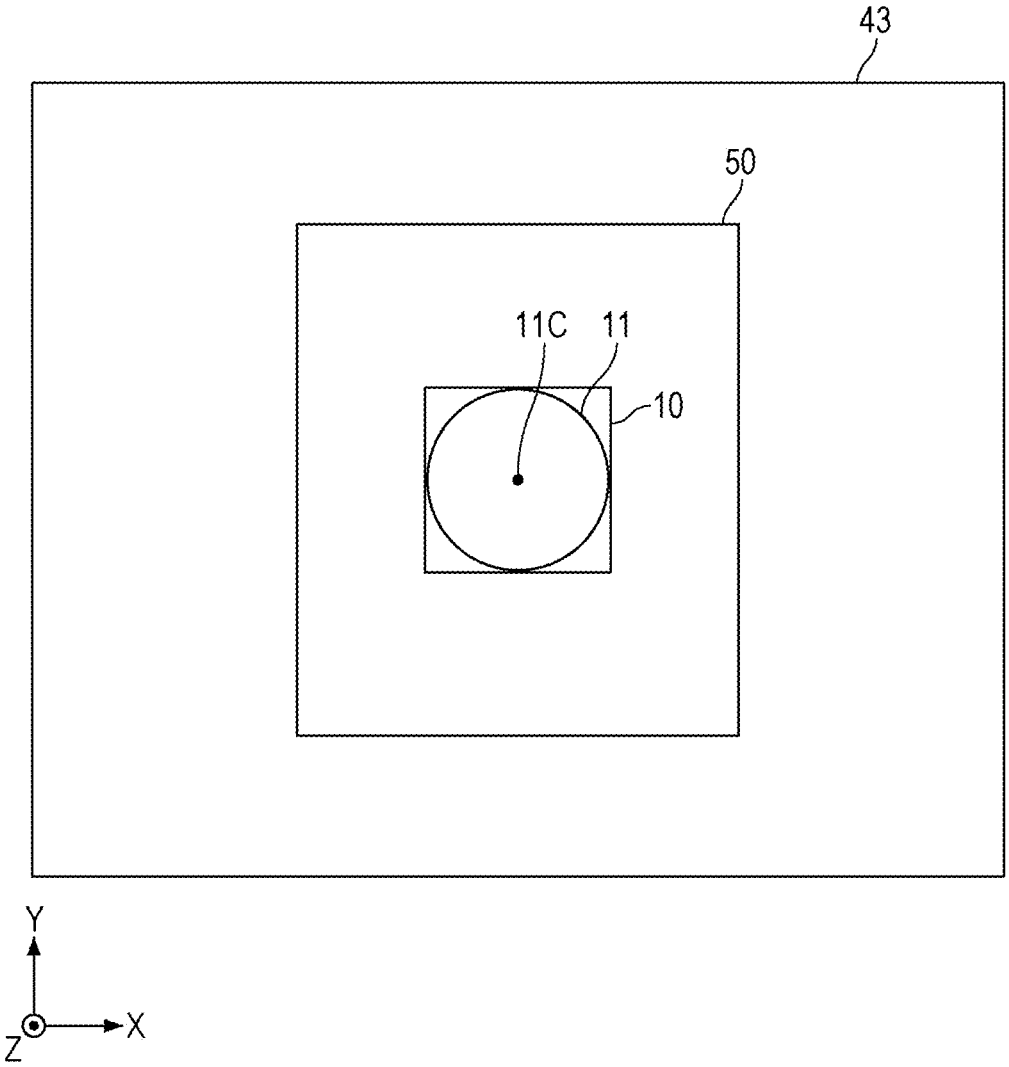
FIG. 11 is a diagram illustrating a display on a display.

In step S1A, as an example, the display processing unit 113 displays the IoT device model 50 and the patch antenna 10 on the display 43 as illustrated in FIG. 11.

Figure 12:
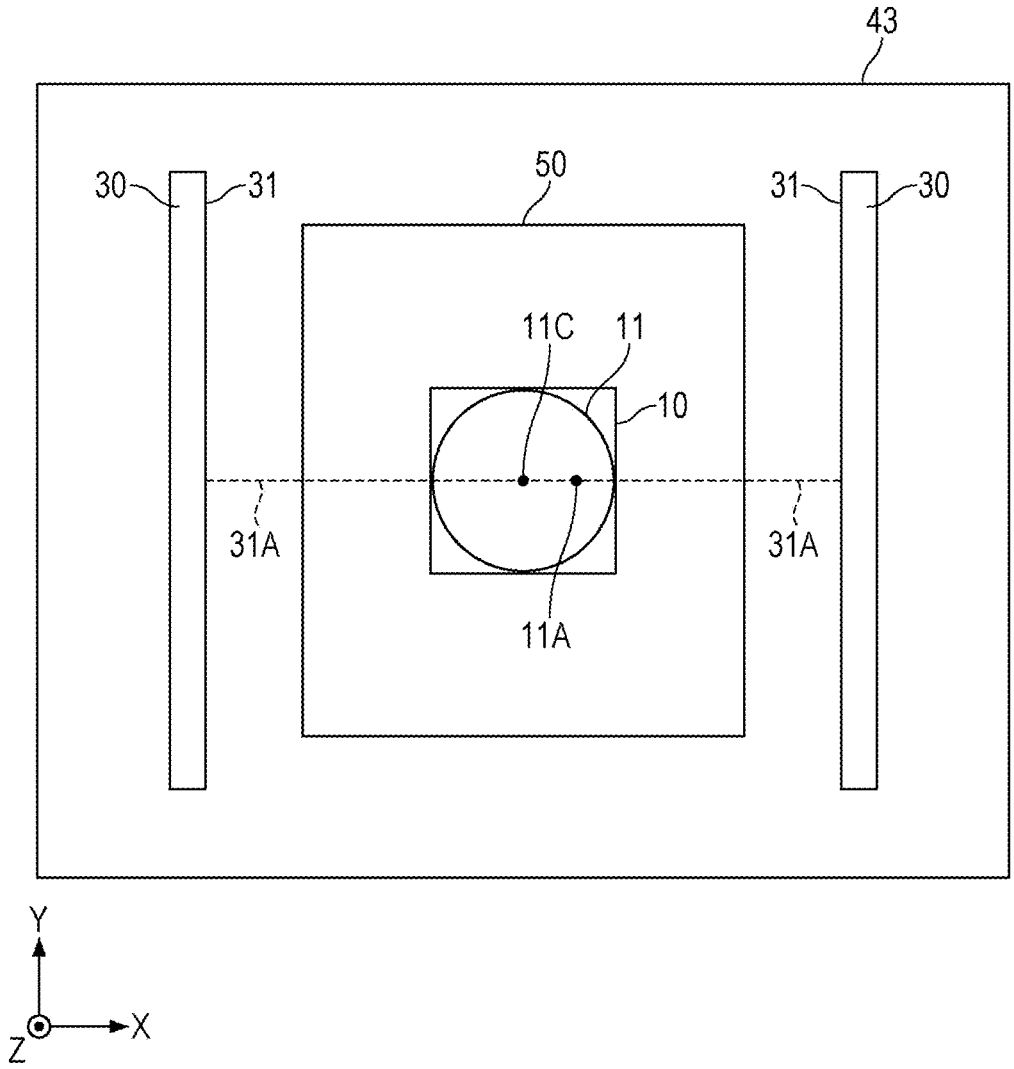
FIG. 12 is a diagram illustrating a display on the display.

In step S4, as an example, as illustrated in FIG. 12, the display processing unit 113 adds the power feeding point 11A, a metal model 30, and a perpendicular line 31A to the display contents illustrated in FIG. 11, and displays them. The metal model 30 represents a direction in which the metal member 20 is permitted to be disposed with respect to the patch antenna 10. The placement permissible direction represents a direction in which the metal member 20 having a surface facing the patch antenna 10 may extend, and the extendable direction is a direction viewed from the patch antenna 10.

The placement permissible direction is represented by an axial direction (X-axis direction (first direction)) including the power feeding point 11A and the center point 11C of the antenna element 11 of the patch antenna 10, and an axial direction (Y-axis direction (second direction)) parallel to the surface of the antenna element 11 and perpendicular to the axial direction (first direction) including the power feeding point 11A and the center point 11C of the antenna element 11.

That is, the placement permissible direction represents the direction in which the metal member 20 may be placed with respect to the patch antenna 10 by the biaxial direction of the X-axis and the Y-axis. In FIG. 12, the metal model 30 illustrates that the metal member 20 is permitted to be disposed on the X-axis positive direction side or the X-axis negative direction side of the patch antenna 10 in a state where a surface 31 is parallel to the YZ plane.

The surface 31 is a surface of the metal model 30 where the surface faces the patch antenna 10, and is the surface closest to the patch antenna 10. The perpendicular line 31A is a perpendicular line perpendicular to the surface 31 passing through the power feeding point 11A and the center point 11C. In step S4, the perpendicular line 31A may not be displayed.

Figure 13:
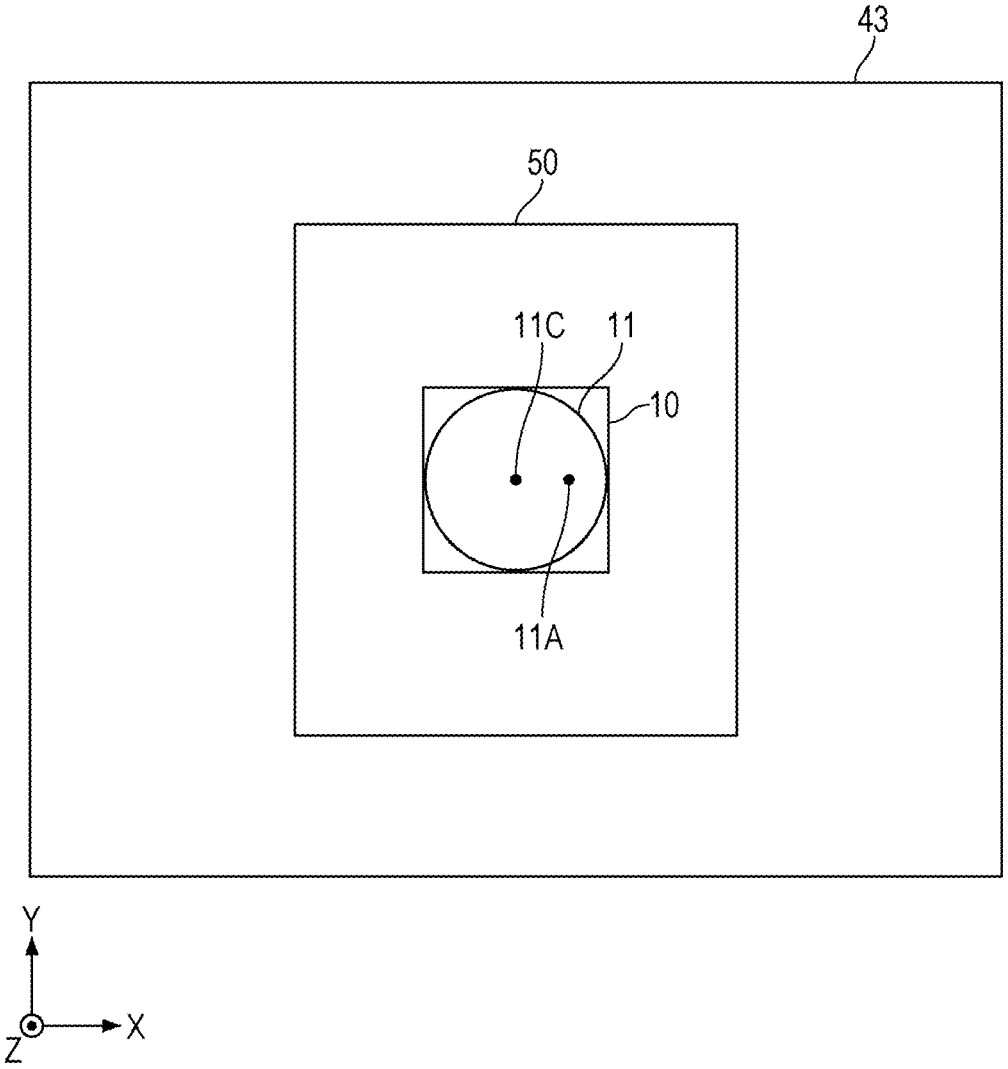
FIG. 13 is a diagram illustrating a display on the display.

In step S6A, as an example, as illustrated in FIG. 13, the display processing unit 113 adds the power feeding point 11A to the display contents illustrated in FIG. 11, and displays it.

Figure 14A:
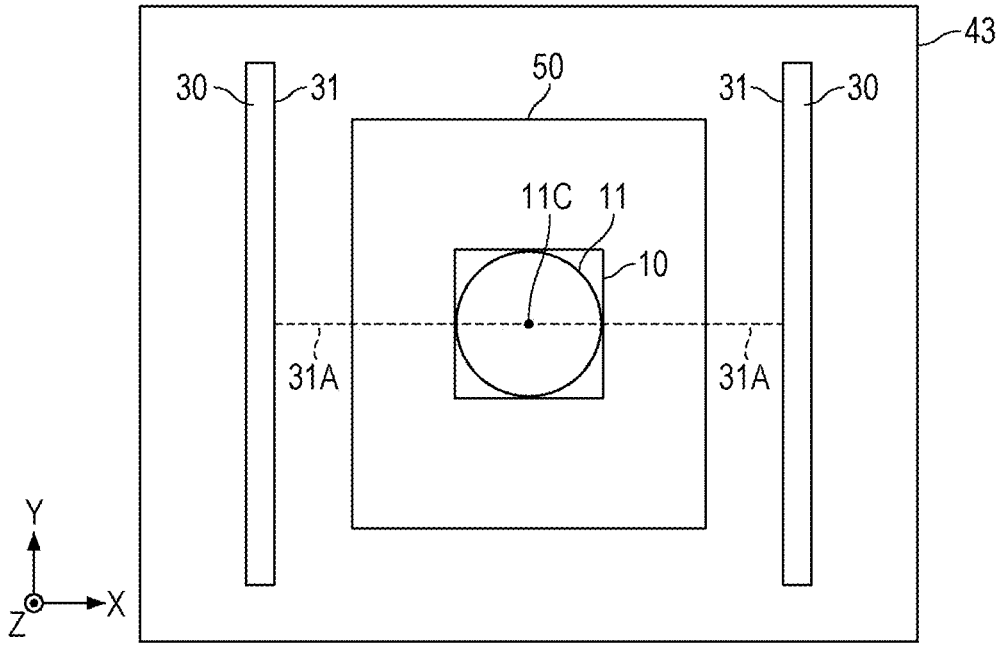
FIGS. 14A and 14B are diagrams illustrating displays on the display.

In step S8, as an example, as illustrated in FIG. 14A, the display processing unit 113 adds the metal model 30 at the position input in step S7 and the perpendicular line 31A passing through the center point 11C of the antenna element 11 to the contents illustrated in FIG. 11, and displays them. In the perpendicular line 31A, the portion excluding the center point 11C from the line segment inside the antenna element 11 is a position where the power feeding point 11A is permitted to be disposed. When the position where the matching is best is obvious from design parameters, the position (two points) where the power feeding point 11A is permitted to be disposed may be displayed in addition to or instead of the perpendicular line 31A.

Figure 14B:
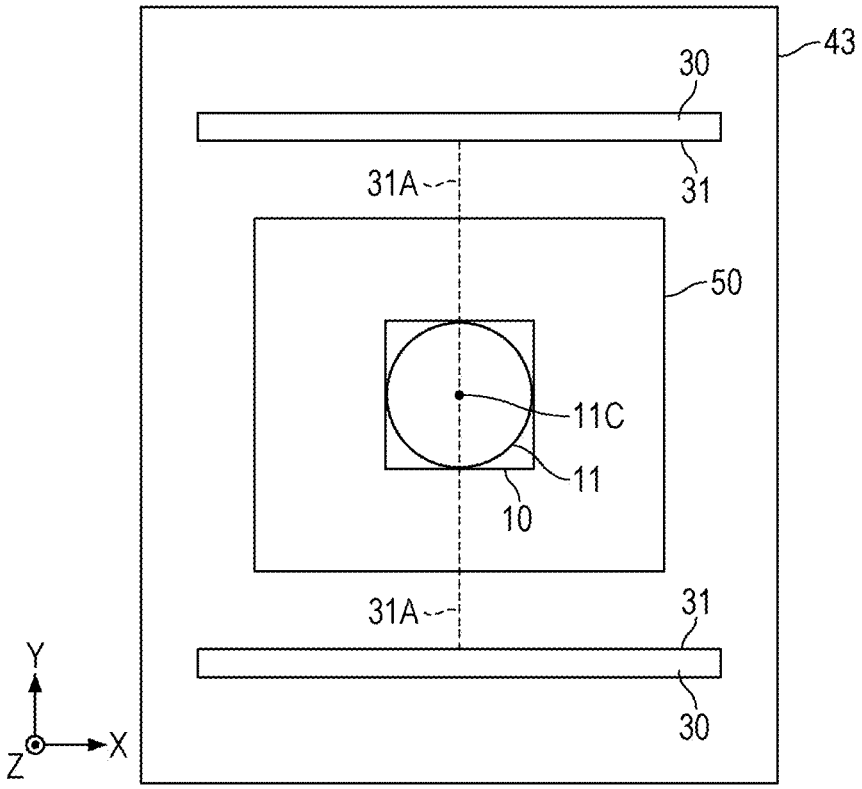

The placement is displayed as illustrated in FIG. 14B when the position of the metal model 30 with respect to the IoT device model 50 differs by 90 degrees from that in FIG. 14A in XY plan view.

In step S4, the embodiment is described in which as illustrated in FIG. 12, the display processing unit 113 adds the power feeding point 11A, the metal model 30, and the perpendicular line 31A to the display contents illustrated in FIG. 11, and displays them.

Figure 15:
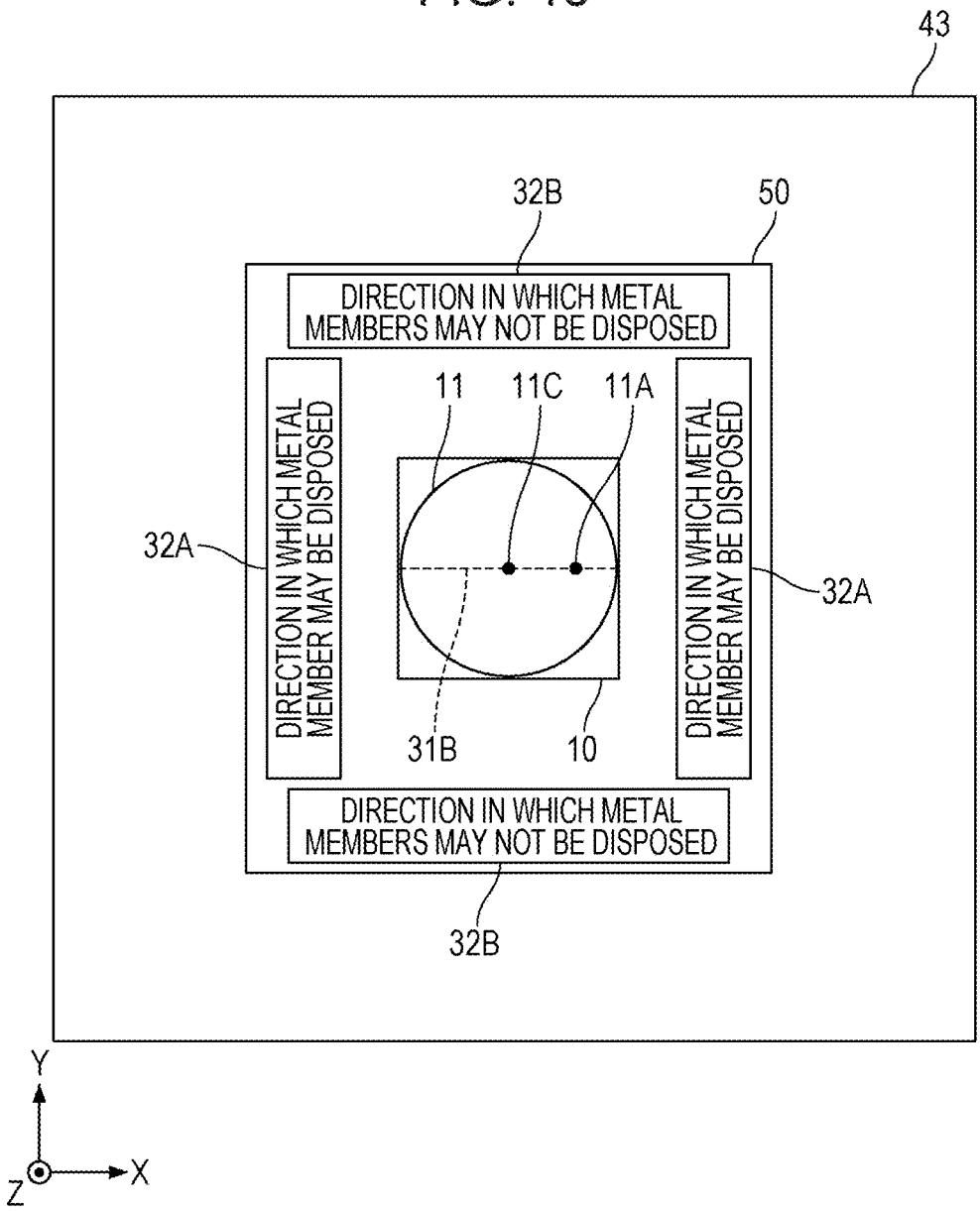
FIG. 15 is a diagram illustrating a display on the display.

However, in step S4, as illustrated in FIG. 15, the direction in which the metal member 20 is permitted to be disposed and the direction in which the metal member 20 is not permitted to be disposed in relation to the power feeding point 11A and the center point 11C of the patch antenna 10 may be superimposed on the display of the IoT device model 50 to be displayed on the display 43 by illustrations 32A and 32B. A virtual perpendicular line 31B coupling the power feeding point 11A and the center point 11C may be displayed. In the plane of the antenna element 11 of the patch antenna 10, the direction (Y-axis direction) perpendicular to the direction (X-axis direction) coupling the power feeding point 11A and the center point 11C is an example of the second direction.

When the user looks at the illustrations 32A and 32B representing the direction in which the metal member 20 displayed on the display 43 is permitted to be disposed and the directions in which the metal member 20 is not permitted to be disposed, for example, the message instructing the user to stick, to the IoT device, the sticker representing the direction in which the metal member 20 is permitted to be disposed and the direction in which the metal member 20 is not permitted to be disposed.

Figure 16A:
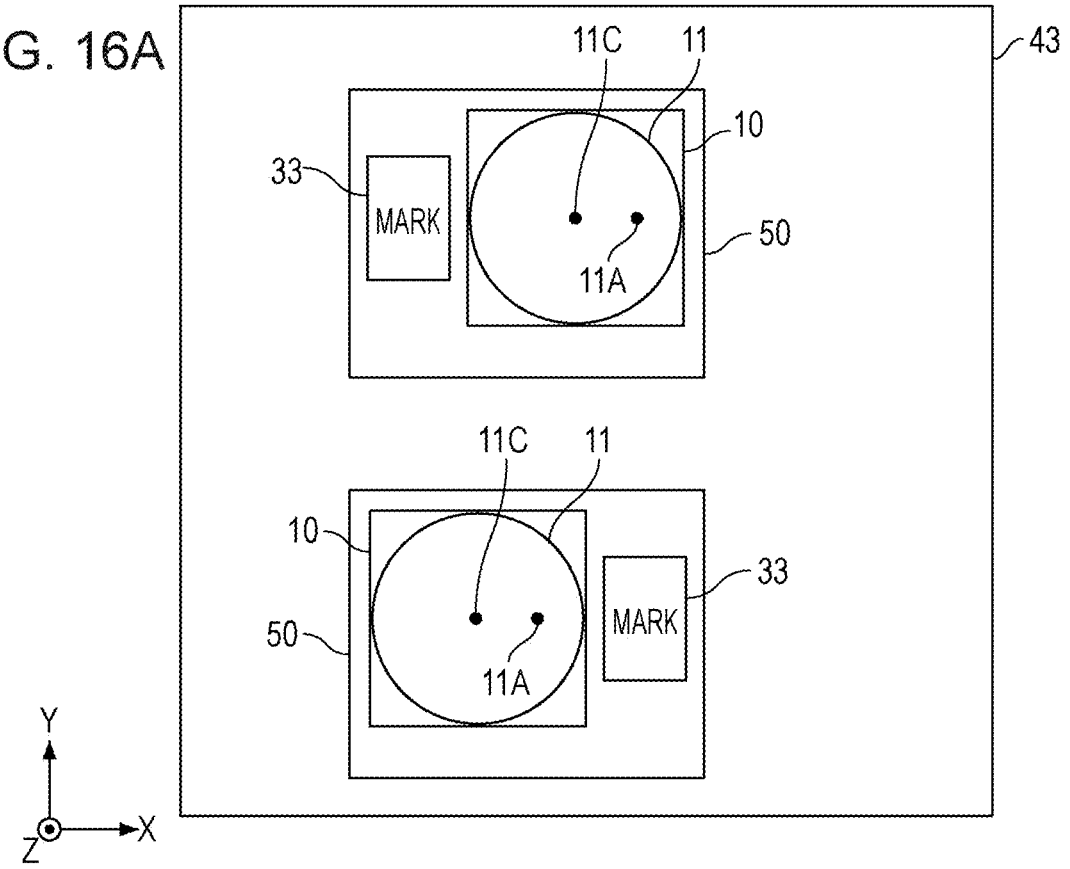
FIGS. 16A and 16B are diagrams illustrating a display on the display and an IoT device according to a modification of the embodiment.
Figure 16B:
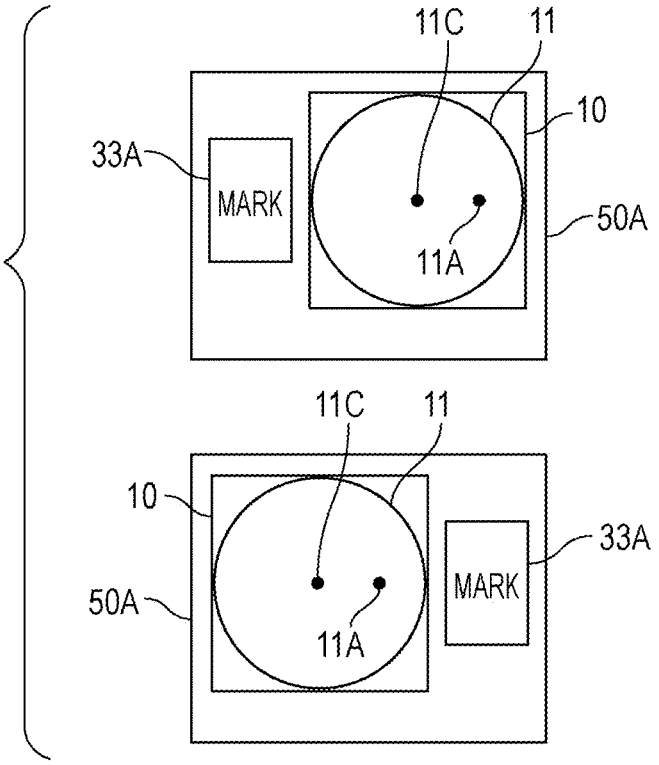

Instead of the process illustrated in FIGS. 12 and 15, the following process may be performed in step S4. FIGS. 16A and 16B are diagrams illustrating the display on the display 43 and an IoT device 50A in a modification of the embodiment.

As illustrated in FIG. 16A, in addition to the patch antenna 10 and the IoT device model 50, a mark 33 representing the direction in which the metal member 20 is permitted to be disposed with respect to the patch antenna 10 is displayed on the display 43. At the stage where the IoT device model 50 is disposed, an object that is covered with a housing and not visible, such as the patch antenna 10, may be omitted.

As illustrated in FIG. 16B, the antenna design support apparatus 100 may impart a real mark 33A to the real IoT device 50A as illustrated in FIG. 16B in the same manner as illustrated on the display 43 in FIG. 16A.

The mark 33A may be a seal or the like representing the logo of the manufacturer, and the instruction manual may clearly indicate that the direction of the mark 33A is a direction in which the metal member 20 is permitted to be disposed. The mark 33A may be is processed on the housing of the IoT device 50A.

As described above, according to the embodiment, in a case where the patch antenna 10 is disposed near the metal member 20, the position of the power feeding point 11A at which appropriate directivity is obtained may be determined when the position of the metal member 20 is determined. When the position of the power feeding point 11A is determined, the position of the metal member 20 at which appropriate directivity is obtained may be determined.

Therefore, it is possible to provide the antenna design support program, the antenna design support apparatus 100, and the antenna design support method that is capable of designing the patch antenna having appropriate directivity when disposed close to the metal member 20.

Figure 17:
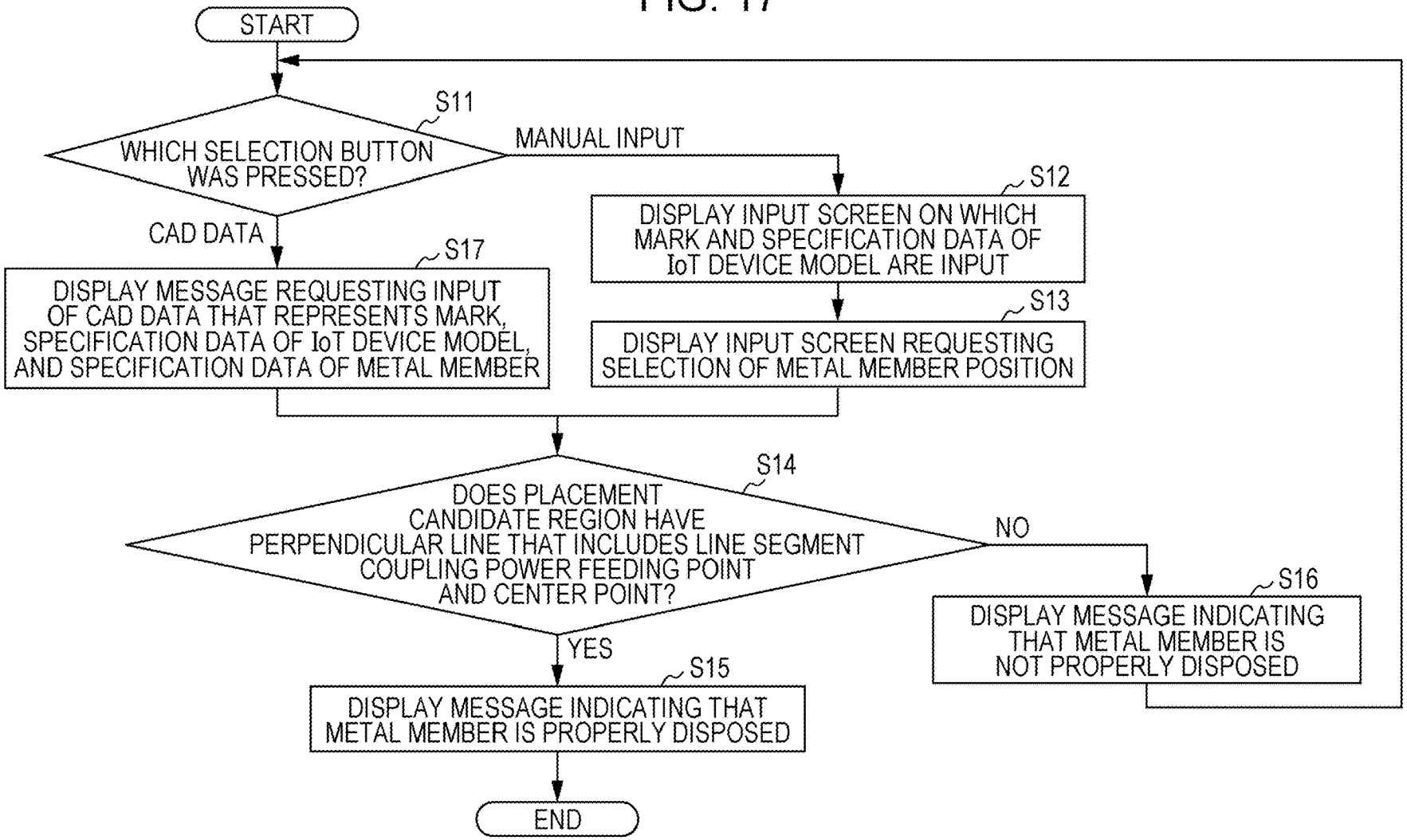
FIG. 17 is a flowchart illustrating a process of an antenna design support method according to a modification of the embodiment.

The process illustrated in FIG. 17 may be performed instead of the process illustrated in FIG. 10. FIG. 17 is a flowchart illustrating a process of an antenna design support method according to a modification of the embodiment. The process illustrated in FIG. 17 is performed by the antenna design support apparatus 100 executing an antenna design support program. The process described here may be regarded as an IoT device placement support method of determining the placement of the IoT device.

When the process starts (START), the main controller 111 displays, on the display 43, a message requesting determination of the design data of the IoT device model 50 and the design data of the metal member 20, and a selection button for selecting a design data input method (manual input or CAD data), and determines which selection button (manual input or CAD data) has been pressed (step S11).

When the main controller 111 determines that the manual input has been selected, the main controller 111 displays, on the display 43, an image of an input screen for inputting the mark and the design data of the IoT device model 50 (step S12). The mark is a mark indicating the direction in which the metal member 20 is permitted to be disposed with respect to the patch antenna 10, and is the same as the mark 33 illustrated in FIG. 16A.

The design data of the IoT device model 50 refers to data representing the design such as the size of the IoT device model 50, the position of each part, the position of the patch antenna 10 in the IoT device model 50, the positions of the power feeding point 11A and the center point 11C (see FIG. 1), and the like.

The user may be allowed to input the mark and the design data of the IoT device model 50 while looking at the display 43 using the keyboard 44 or the mouse. In step S12, the mark and the patch antenna 10 are displayed on the display 43, but the power feeding point 11A and the center point 11C are not displayed.

When the input of the mark and the design data of the IoT device model 50 is completed, the main controller 111 displays, on the display 43, an input screen for requesting the user to select the position of the metal member 20 (step S13). As an example, in the plan view of the patch antenna 10, a region in which the metal member 20 is to be disposed around the IoT device model 50 (placement candidate region) is displayed, and the user may select any one of the placement candidate regions. The user selects a placement candidate region while looking at the patch antenna 10 and the mark displayed on the display 43.

The direction determination unit 112B obtains, from the mark, the direction in which the line segment coupling the power feeding point 11A and the center point 11C extends, and determines whether the placement candidate region selected in step S13 has a perpendicular line including the line segment coupling the power feeding point 11A and the center point 11C (step S14).

In step S14, when the direction determination unit 112B determines that the placement candidate region has a perpendicular line including the line segment coupling the power feeding point 11A and the center point 11C (S14: "YES"), the main controller 111 displays, on the display 43, a message indicating that the placement of the metal member 20 is appropriate (step S15).

Upon completion of the process of step S15, the main controller 111 ends the series of processes (END).

In step S14, when the direction determination unit 112B determines that the placement candidate region does not have a perpendicular line including the line segment coupling the power feeding point 11A and the center point 11C (S14: "NO"), the main controller 111 displays, on the display 43, a message indicating that the placement of the metal member 20 is not appropriate (step S16). In step S16, an image representing an appropriate placement of the metal member 20 may be displayed on the display 43.

Upon completion of the process of step S16, the main controller 111 returns the flow to step S11.

In step S11, when it is determined that the selection button for selecting the CAD data has been pressed, the main controller 111 displays, on the display 43, the mark, the design data of the IoT device model 50, and a message requesting input of the CAD data representing the design data of the metal member 20 (step S17).

The CAD data representing the design data of the IoT device model 50 refers to CAD data representing the specification such as the size of the IoT device model 50, the position of each part, the position of the patch antenna 10 in the IoT device model 50, the positions of the power feeding point 11A and the center point 11C (see FIG. 1), and the like.

The CAD data representing the design data of the metal member 20 refers to CAD data representing the size, the shape, the material name, and the like of the metal member 20.

The CAD data representing the design data of the IoT device model 50 and the design data of the metal member 20 may be read from the memory 42 when stored in the memory 42 of the antenna design support apparatus 100. The user may download the CAD data representing the design data of the IoT device model 50 and the design data of the metal member 20 in a state where the antenna design support apparatus 100 is coupled to a network such as the Internet. The CAD data representing the design data of the IoT device model 50 and the design data of the metal member 20 may be obtained by another method.

In step S17, the mark 43 and the patch antenna 10 are displayed on the display 43, but the power feeding point 11A and the center point 11C are not displayed.

Figure 18:
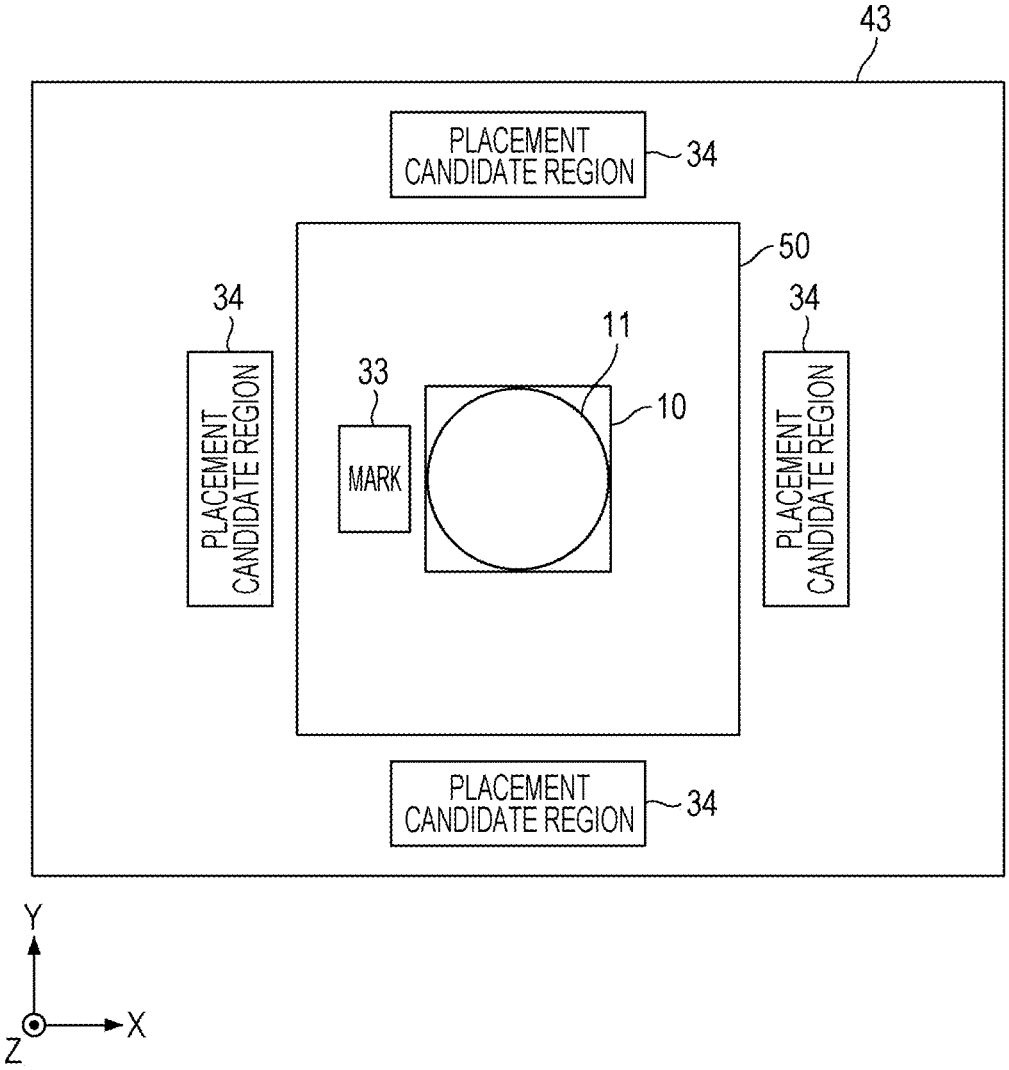
FIG. 18 is a diagram illustrating an example of an image displayed on the display.

In step S13 in the above-described process, for example, an image as illustrated in FIG. 18 may be displayed on the display 43. FIG. 18 is a diagram illustrating an example of the image displayed on the display 43 in step S13.

As illustrated in FIG. 18, in the display of the patch antenna 10 in XY plan view, placement candidate regions 34 are displayed around the IoT device model 50 while the mark 33 is displayed near the patch antenna 10, and the user may select any one of the placement candidate regions 34.

In step S14, of the four placement candidate regions 34 illustrated in FIG. 18, when the placement candidate region 34 located on the X-axis positive direction side or the X-axis negative direction side with respect to the patch antenna 10 is selected, it is determined that the placement candidate region 34 has a perpendicular line including a line segment coupling the power feeding point 11A and the center point 11C. An object that is covered by the housing and not visible, such as the patch antenna 10, may be omitted.

Figure 19:
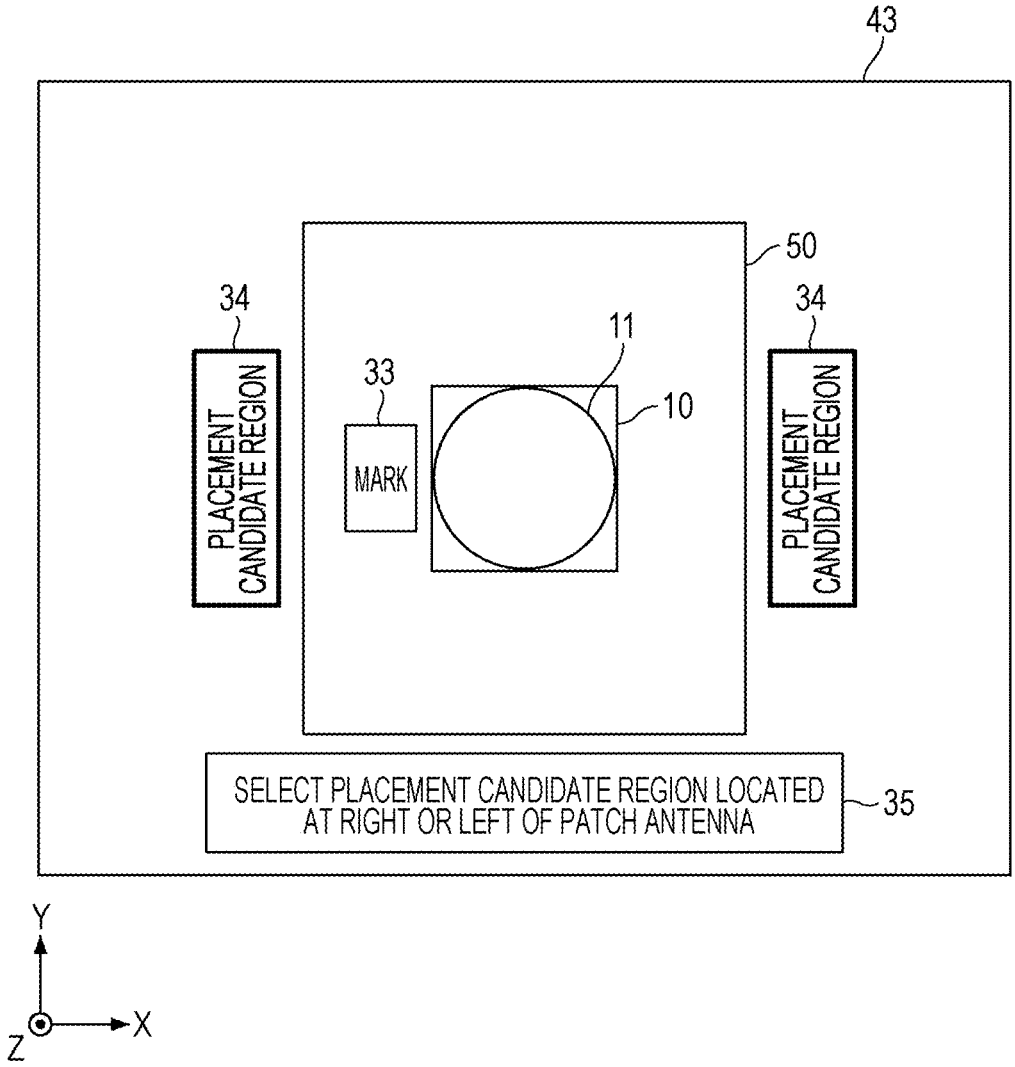
FIG. 19 is a diagram illustrating an example of an image displayed on the display.

In step S16, as illustrated in FIG. 19, the placement candidate regions 34 located on the X-axis positive direction side and the X-axis negative direction side with respect to the patch antenna 10 may be highlighted, and a message 35 stating "select the placement candidate region 34 located at the right or the left of the patch antenna 10" may be displayed. FIG. 19 is a diagram illustrating an example of an image displayed on the display 43 in step S16. An object that is covered by the housing and not visible, such as the patch antenna 10, may be omitted.

As described above, according to the process illustrated in FIG. 17, as in the process illustrated in FIG. 10, in a case where the patch antenna 10 is disposed near the metal member 20, the position of the power feeding point 11A at which appropriate directivity is obtained may be determined when the position of the metal member 20 is determined. When the position of the power feeding point 11A is determined, the position of the metal member 20 at which appropriate directivity is obtained may be determined.

Therefore, it is possible to provide the antenna design support program, the antenna design support apparatus 100, and the antenna design support method that is capable of designing the patch antenna having appropriate directivity when disposed close to the metal member 20.

In FIG. 17, the embodiment is described in which the user is requested to input the mark 33 (see FIG. 18), and it is determined whether the placement candidate region 34 has a perpendicular line including a line segment coupling the power feeding point 11A and the center point 11C using the mark 33.

However, instead of using the mark 33, using the positions of the power feeding point 11A and the center point 11C, it is determined whether the placement candidate region 34 has a perpendicular line including a line segment coupling the power feeding point 11A and the center point 11C. In this case, it is not required to ask the user to input the mark 33.

In the process of step S11 in FIG. 17, a button for selecting an appearance photograph of the IoT device 50A may be added to the manual input and the CAD data as the design data input method. When the patch antenna 10, the power feeding point 11A, and the center point 11C may be identified from the appearance of the IoT device 50A, the positional relationship between the power feeding point 11A and the center point 11C may be identified from the appearance photograph to perform the processes after step S12.

Figure 20:
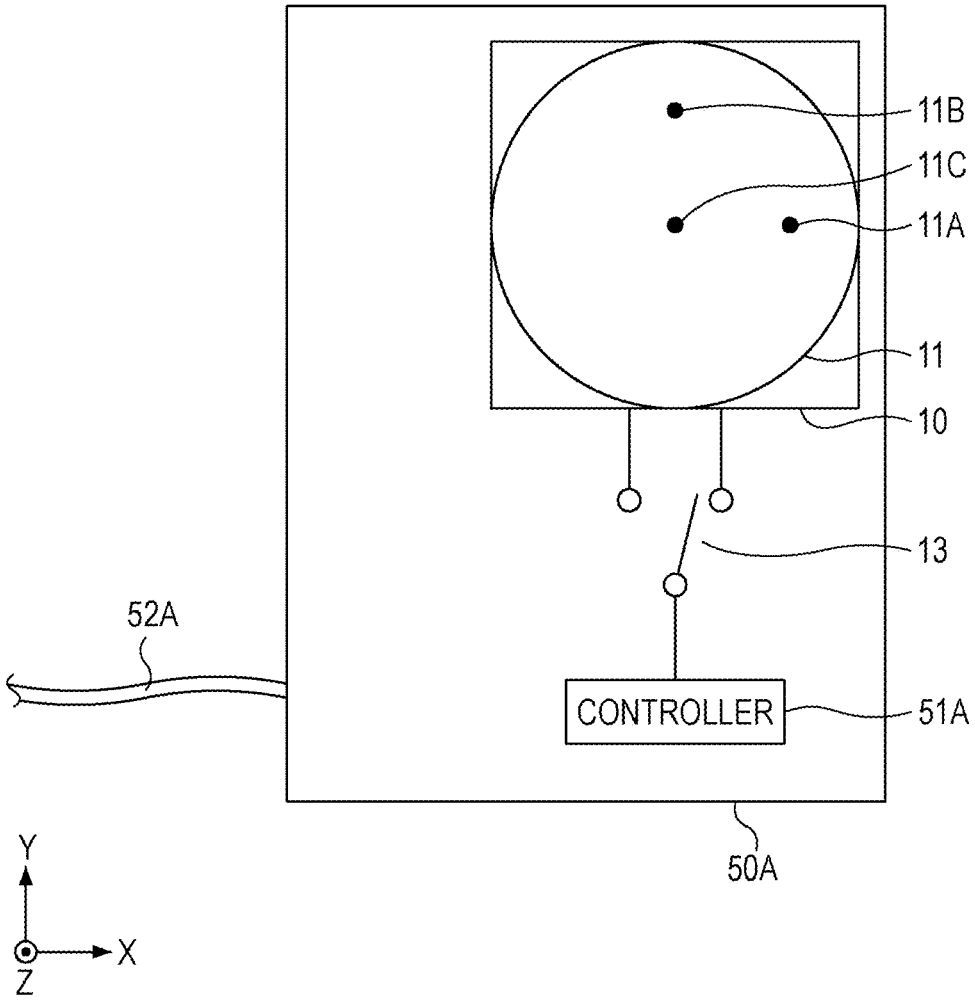
FIG. 20 is a diagram illustrating the IoT device according to a modification of the embodiment.
Figure 21:
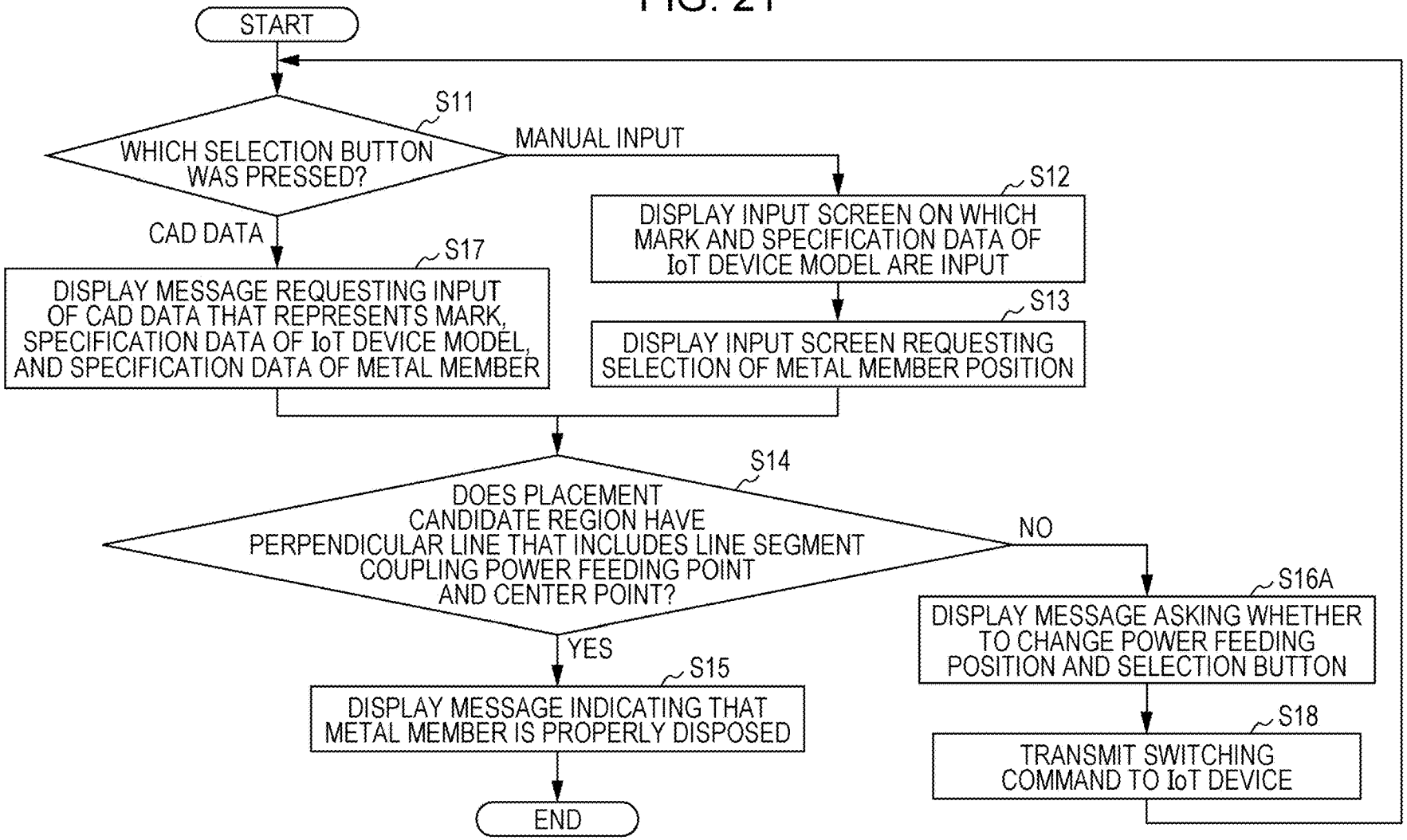
FIG. 21 is a diagram illustrating a flowchart according to the modification of the embodiment.
Figure 22:
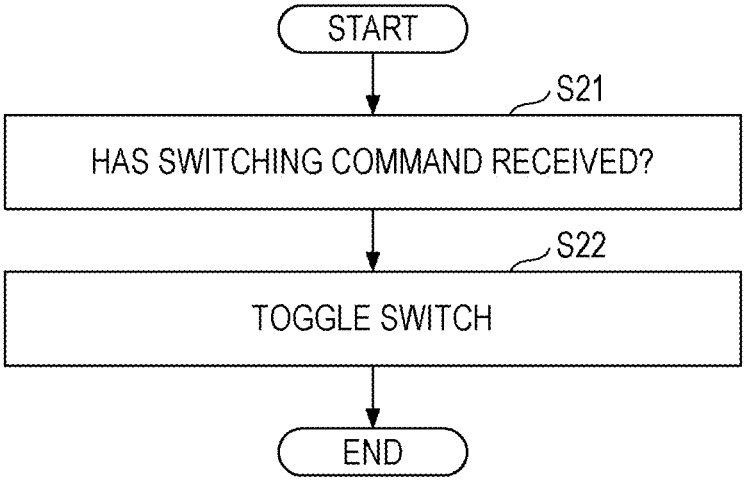
FIG. 22 is a diagram illustrating a flowchart representing a process performed by the IoT device according to the modification of the embodiment.

The processing content of step S16 illustrated in FIG. 17 may be changed, and thereafter, a further process may be added. The process is described with reference to FIGS. 20 and 21. FIG. 20 is a diagram illustrating the IoT device 50A according to a modification of the embodiment. FIG. 21 is a diagram illustrating a flowchart according to the modification of the embodiment. FIG. 22 is a diagram illustrating a flowchart representing a process performed by the IoT device 50A according to the modification of the embodiment.

As a premise, the antenna design support apparatus 100 is capable of data communication with the IoT device 50A via a cable or the like, and the IoT device 50A has a switch 13 for switching a plurality of power feeding points 11A and 11B as illustrated in FIG. 20. The IoT device 50A includes a controller 51A whose function is implemented by a microcomputer or the like, and the controller 51A toggles the switch 13 based on a command input from the antenna design support apparatus 100 via a cable 52A. Wireless communication may be used instead of the cable 52A.

The flowchart illustrated in FIG. 21 is obtained by changing step S16 in the flowchart illustrated in FIG. 17 to step S16A and adding step S18 after step S16A.

In step S14, when the direction determination unit 112B determines that the placement candidate region does not have a perpendicular line including the line segment coupling the power feeding point 11A and the center point 11C (S14: "NO") the main controller 111 displays, on the display 43, a message asking whether to change the power feed position, and a button for selecting whether to change the power feeding position (step S16A).

When the button for changing the feed position in step S16A is pressed, the main controller 111 transmits, to the IoT device 50A, a switching command for switching the power feeding point (step S18). The switching command is transmitted to the IoT device 50A via the cable 52A.

The main controller 111 ends the series of processing (END) when a button for not changing the feed position is pressed in step S16A.

As illustrated in FIG. 22, the controller 51A determines whether the switching command has been received (step S21).

When receiving the switching command, the controller 51A toggles the switch 13 (step S22).

The controller 51A ends the series of processes after completing the process of step S22 (END).

For example, with the switch 13 coupled to the power feeding point 11A, when it is determined in step S14 illustrated in FIG. 21 that the placement candidate region does not have a perpendicular line including the line segment coupling the power feeding point 11A and the center point 11C (S14: "NO"), the switch 13 is coupled to the power feeding point 11B through the process of step S22.

Since the power feeding point 11B is located at a position counterclockwise by 90 degrees in plan view with respect to the center point 11C, a switchover from vertical polarization to horizontal polarization may be performed.

The embodiment is described in which the patch antenna 10 has two power feeding points 11A and 11B, which are switched by the switch 13. The patch antenna 10 may have three or more power feeding points, and may be switchable to any one of the power feeding points by the switch 13.

As described above, according to the process illustrated in FIG. 21, as in the process illustrated in FIGS. 10 and 17, in a case where the patch antenna 10 is disposed near the metal member 20, the position of the power feeding point 11A and 11B at which appropriate directivity is obtained may be determined when the position of the metal member 20 is determined. When the position of the power feeding point 11A or 11B is determined, the position of the metal member 20 at which appropriate directivity is obtained may be determined.

When the user does not select the position of the metal member 20 at which appropriate directivity may be obtained, the position of the power feeding point may be changed so that the position of the metal member 20 that appropriate directivity may be obtained may be obtained.

Therefore, it is possible to provide the antenna design support program, the antenna design support apparatus 100, and the antenna design support method that is capable of designing the patch antenna having appropriate directivity when disposed close to the metal member 20.

Although in FIG. 20, the embodiment is described in which the controller 51A switches the power feeding points 11A and 11B by the switch 13, the patch antenna 10 may have one power feeding point 11A, and the IoT device 50A may include a mechanism for rotating the patch antenna 10 in the XY plane, and the patch antenna 10 may be rotated instead of switching the power feeding points 11A and 11B as described above.

In the above description, the embodiment is described in which in which the positional relationship between the power feeding point 11A and the center point 11C, and the metal member 20 is adjusted so as to obtain vertical polarization. When vertical polarization is obtained in this way, even when the patch antenna 10 is disposed near the metal member 20, as illustrated in FIG. 5A, the directivity closest to the direction in which the patch antenna 10 faces (the +Z direction in FIG. 5A) is obtained, and excellent radiation characteristics of the patch antenna 10 may be obtained.

However, for example, when the communication distance of the patch antenna 10 does not have to be very long, or when an ideal placement is difficult due to the positional relationship with the surrounding metal member 20, communication maybe performed in a direction deviating from the direction of in which directivity is the highest indicated by the arrow in FIG. 5A.

Figure 23A:
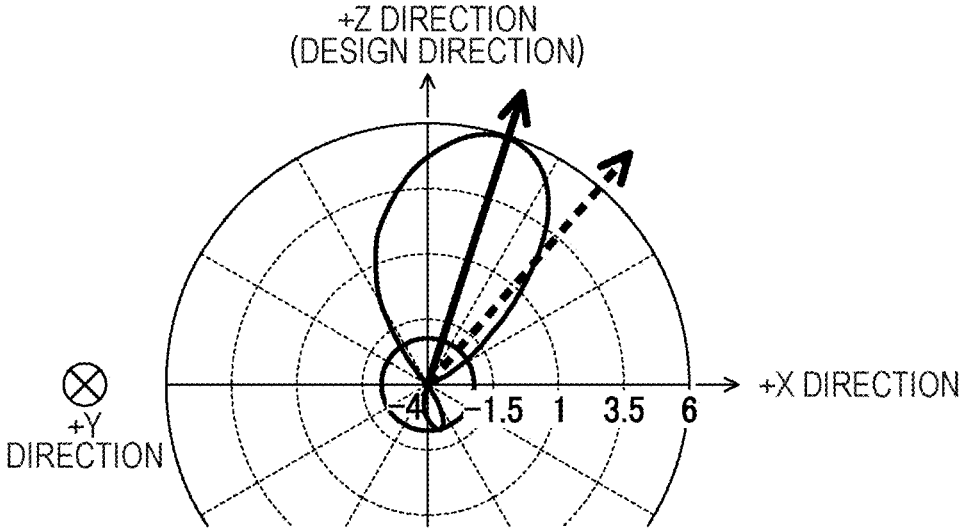
FIGS. 23A and 23B are diagrams illustrating directivity of the 0-degree and the 90-degree patch antenna.
Figure 23B:
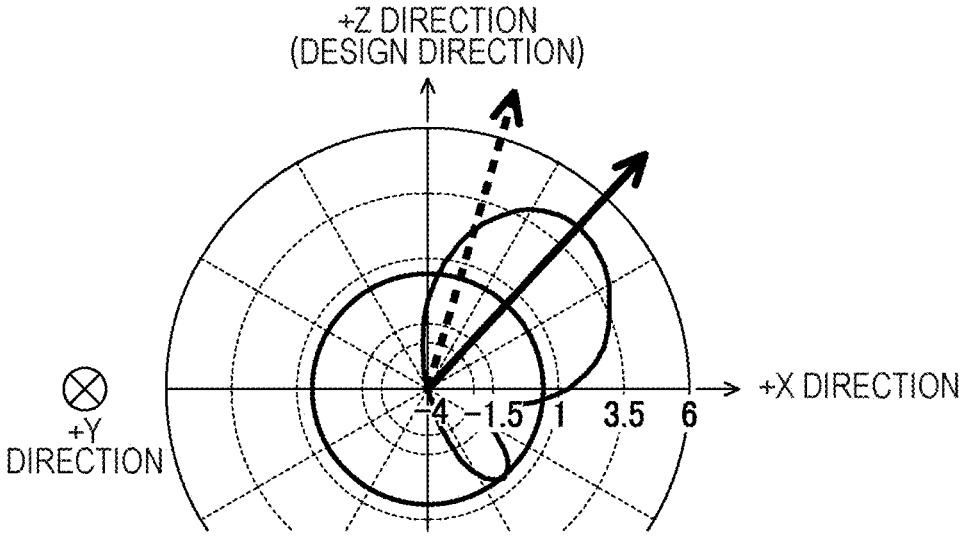

FIGS. 23A and 23B are diagrams illustrating the directivity of the 0-degree and the 90-degree patch antenna 10. The directivity illustrated in FIGS. 23A and 23B are obtained by the electromagnetic field simulation, and are diagrams illustrating simulation results of radiation patterns (absolute gain characteristics (dB)) on the XZ plane.

As illustrated in FIG. 23A, in the 0-degree patch antenna 10, communication may be performed in a direction in which the directivity is slightly low to some extent, for example, as indicated by the dashed arrow rather than in a direction of the main lobe, indicated by the solid arrow, in which directivity is the highest. The direction indicated by the broken line arrow is determined as the direction deviating from the direction indicated by the solid line arrow after obtaining the direction of in which directivity indicated by the solid line arrow by the method illustrated in FIG. 10, FIG. 17, and FIG. 21.

As illustrated in FIG. 23B, after the direction of the main lobe, indicated by the solid arrow, in which directivity is the highest is obtained using the 90-degree patch antenna 10, a direction indicated by the broken line deviating from the direction may be selected as the direction used for communication.

The antenna design support program, the antenna design support apparatus, and the antenna design support method according to the exemplary embodiments have been described above. The embodiments are not limited to the specifically disclosed embodiments, various modifications and changes are possible without departing from the scope of the claims. Further, the following appendices will be disclosed regarding the above embodiments.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A non-transitory computer-readable recording medium having stored therein a program that, when a processor coupled to a memory and the processor is configured to execute the program, causes the processor to:

store, in the memory, a design data of a metal member disposed near a patch antenna having a ground conductor and an antenna element having a power feeding point, and a positional relationship between the metal member and the patch antenna, determine a relative position between the power feeding point and the metal member so that a center point and the power feeding point of the patch antenna in plan view are located on a perpendicular line to a surface of the metal member on a front side of the patch antenna based on the design data of the metal member and the positional relationship stored in the memory, display, on a display, a direction in which the metal member is permitted to be disposed in relation to the patch antenna in plan view, wherein the direction includes a second direction perpendicular to a first direction coupling the power feeding point and the center point in a face including a surface of the antenna element;

wherein the direction is based on a relative position of the determined power feeding point and the metal member;

wherein the processor displays the direction that includes another direction in which the metal member is not permitted to be disposed in relation to the patch antenna in plan view based on the relative position of the determined power feeding point and the metal member; and wherein the second direction in which the metal member is not permitted to be disposed in relation to the patch antenna in plan view.

2. The computer-readable recording medium having stored therein the program according to claim 1, wherein the relative position between the power feeding point and the metal member is further determined so that a radio wave radiated from the patch antenna is vertical polarization when the surface of the metal member is a ground.

3. The computer-readable recording medium having stored therein the program according to claim 1, wherein the first direction in which the metal member is permitted to be disposed in relation to the patch antenna in plan view.

4. The computer-readable recording medium having stored therein the program according to claim 1, wherein the patch antenna is provided in an electronic device, and wherein the processors is configured to impart, when a position of the power feeding point is determined, to the electronic device, a mark indicating an additional direction in which the metal member is permitted to be disposed based on a relative position of the determined power feeding point and the metal member.

5. The computer-readable recording medium having stored therein the program according to claim 1, wherein the processor is configured to display, when positions of the patch antenna and the metal member are determined, on the display, a position in which the power feeding point is permitted to be disposed based on a relative position of the determined power feeding point and the metal member.

6. The computer-readable recording medium having stored therein the program according to claim 5, wherein the processor is configured to display an additional direction which includes a position in which the power feeding point may be placed, the position being on the perpendicular line.

7. An apparatus comprising:

a memory; and a processor coupled to the memory and the processor configured to:

store, in the memory, a design data of a metal member disposed near a patch antenna having a ground conductor and an antenna element having a power feeding point, and a positional relationship between the metal member and the patch antenna;

determine a relative position between the power feeding point and the metal member so that a center point and the power feeding point of the patch antenna in plan view are located on a perpendicular line to a surface of the metal member on a front side of the patch antenna based on the design data of the metal member and the positional relationship stored in the memory;

display, on a display, a direction in which the metal member is permitted to be disposed in relation to the patch antenna in plan view, wherein the direction includes a second direction perpendicular to a first direction coupling the power feeding point and the center point in a face including a surface of the antenna element;

wherein the direction is based on a relative position of the determined power feeding point and the metal member;

wherein the processor displays the direction that includes another direction in which the metal member is not permitted to be disposed in relation to the patch antenna in plan view based on the relative position of the determined power feeding point and the metal member; and wherein the second direction in which the metal member is not permitted to be disposed in relation to the patch antenna in plan view.

8. A method executed by a processor coupled to a memory, comprising:

storing, in the memory, a design data of a metal member disposed near a patch antenna having a ground conductor and an antenna element having a power feeding point, and a positional relationship between the metal member and the patch antenna;

determining a relative position between the power feeding point and the metal member so that a center point and the power feeding point of the patch antenna in plan view are located on a perpendicular line to a surface of the metal member on a front side of the patch antenna based on the design data of the metal member and the positional relationship stored in the memory, displaying, on a display, a direction in which the metal member is permitted to be disposed in relation to the patch antenna in plan view, wherein the direction includes a second direction perpendicular to a first direction coupling the power feeding point and the center point in a face including a surface of the antenna element;

wherein the direction is based on a relative position of the determined power feeding point and the metal member;

wherein the processor displays a direction that includes another direction in which the metal member is not permitted to be disposed in relation to the patch antenna in plan view based on the relative position of the determined power feeding point and the metal member; and wherein the second direction in which the metal member is not permitted to be disposed in relation to the patch antenna in plan view.

* * * * *